US009575422B2

(12) United States Patent
Okuda et al.

(10) Patent No.: US 9,575,422 B2
(45) Date of Patent: Feb. 21, 2017

(54) METHOD OF PRODUCING ELECTROPHOTOGRAPHIC PHOTOSENSITIVE MEMBER, METHOD OF PRODUCING ORGANIC DEVICE, AND EMULSION FOR CHARGE TRANSPORTING LAYER

(71) Applicant: CANON KABUSHIKI KAISHA, Tokyo (JP)

(72) Inventors: Atsushi Okuda, Yokohama (JP); Keiko Yamagishi, Kawasaki (JP); Harunobu Ogaki, Suntou-gun (JP); Yohei Miyauchi, Tokyo (JP); Hiroki Uematsu, Mishima (JP); Kimihiro Yoshimura, Yokohama (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 224 days.

(21) Appl. No.: 14/353,463

(22) PCT Filed: Dec. 11, 2012

(86) PCT No.: PCT/JP2012/082600
§ 371 (c)(1),
(2) Date: Apr. 22, 2014

(87) PCT Pub. No.: WO2013/094548
PCT Pub. Date: Jun. 27, 2013

(65) Prior Publication Data

US 2014/0315124 A1 Oct. 23, 2014

(30) Foreign Application Priority Data

Dec. 22, 2011 (JP) ..... 2011-282083
Dec. 6, 2012 (JP) ..... 2012-267389

(51) Int. Cl.
*H05B 33/10* (2006.01)
*G03G 5/04* (2006.01)
*G03G 5/05* (2006.01)
*G03G 5/06* (2006.01)
*G03G 5/147* (2006.01)
(Continued)

(52) U.S. Cl.
CPC ..... *G03G 5/04* (2013.01); *G03G 5/0525* (2013.01); *G03G 5/0564* (2013.01);
(Continued)

(58) Field of Classification Search
None
See application file for complete search history.

(56) References Cited

U.S. PATENT DOCUMENTS 5,531,872 A 7/1996 Forgit et al.
7,629,102 B2 12/2009 Ochi et al.
(Continued)

FOREIGN PATENT DOCUMENTS

CN 101689031 3/2010
EP 2 172 810 A1 4/2010
(Continued)

OTHER PUBLICATIONS

Yamagishi, et al., U.S. Appl. No. 14/359,563, filed May 20, 2014.
(Continued)

*Primary Examiner* — Nathan T Leong
(74) *Attorney, Agent, or Firm* — Fitzpatrick, Cella, Harper & Scinto

(57) ABSTRACT

Provided are a method of producing an electrophotographic photosensitive member, particularly, a method of producing an electrophotographic photosensitive member and an organic device by which, in a method of forming a charge transporting layer, the stability of an application liquid for the layer after long-term storage is improved while the usage of an organic solvent in the application liquid is curtailed, and the layer having high uniformity is formed. The method
(Continued)

is a method of producing an electrophotographic photosensitive member which includes a support and a charge transporting layer formed thereon, the method including: preparing a solution including: a first liquid whose solubility in water under 25° C. and 1 atmosphere is 1.0 mass % or less; a second liquid whose solubility in water under 25° C. and 1 atmosphere is 5.0 mass % or more; a charge transporting substance; and a binder resin; preparing an emulsion by dispersing the solution in water; forming a coat for the layer on the support by using the emulsion; and forming the layer by heating of the coat.

20 Claims, 1 Drawing Sheet

(52) U.S. Cl.
CPC ..... *G03G 5/0614* (2013.01); *G03G 5/14708* (2013.01); *G03G 5/14756* (2013.01); *H05B 33/10* (2013.01)

(56) References Cited

U.S. PATENT DOCUMENTS

2008/0199794 A1* 8/2008 Uesugi ..... G03G 5/0539 430/66
2009/0023091 A1* 1/2009 Ochi ..... G03G 5/047 430/133

FOREIGN PATENT DOCUMENTS

| | | | |
|---|---|---|---|
| EP | 2 253 681 | A1 | 11/2010 |
| JP | 7-313915 | A | 12/1995 |
| JP | 2005-310408 | A | 11/2005 |
| JP | 2007-79555 | A | 3/2007 |
| JP | 2007-87847 | A | 4/2007 |
| JP | 2009-288401 | A | 12/2009 |
| JP | 2011-128213 | A | 6/2011 |
| JP | 4770125 | | 9/2011 |
| WO | 2009/011072 | A1 | 1/2009 |
| WO | 2013/137282 | A1 | 9/2013 |

OTHER PUBLICATIONS

Ogaki, et al., U.S. Appl. No. 14/359,272, filed May 19, 2014.
Okuda, et al., U.S. Appl. No. 14/304,172, filed Jun. 13, 2014.
PCT International Search Report and Written Opinion of the International Searching Authority, International Application No. PCT/JP2012/082600, Mailing Date Feb. 5, 2013.
European Search Report dated Jul. 14, 2015 in European Application No. 12860113.5.

* cited by examiner

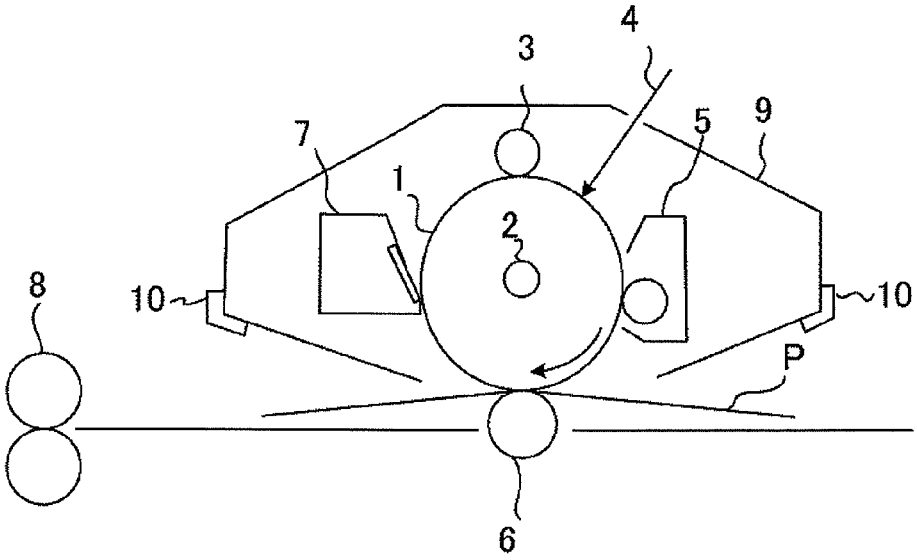
4
3
7
5
9
1
2
8
10
10
P
6

METHOD OF PRODUCING ELECTROPHOTOGRAPHIC PHOTOSENSITIVE MEMBER, METHOD OF PRODUCING ORGANIC DEVICE, AND EMULSION FOR CHARGE TRANSPORTING LAYER

TECHNICAL FIELD

The present invention relates to a method of producing an electrophotographic photosensitive member, a method of producing an organic device, and an emulsion for a charge transporting layer.

BACKGROUND ART

An organic electrophotographic photosensitive member (hereinafter, sometimes referred to as "electrophotographic photosensitive member") containing an organic photoconductive substance has been vigorously developed as an electrophotographic photosensitive member to be mounted on an electrophotographic apparatus. In addition, at present, the organic electrophotographic photosensitive member has been a mainstream electrophotographic photosensitive member to be used in the process cartridge of an electrophotographic apparatus or in the electrophotographic apparatus, and has been put into large-scale production. Of such organic electrophotographic photosensitive members, a laminated electrophotographic photosensitive member has been frequently used. The laminated electrophotographic photosensitive member improves its features by separating functions needed for an electrophotographic photosensitive member into its respective layers.

A method involving dissolving a functional material in an organic solvent to produce an application solution and applying the solution onto a support has been generally employed as a method of producing the laminated electrophotographic photosensitive member. Of the respective layers of the laminated electrophotographic photosensitive member, a charge transporting layer is often required to have durability. Accordingly, the thickness of a coat of the application liquid for the charge transporting layer is larger than that of any other layer and hence the usage of the application liquid for the charge transporting layer is also large. As a result, the layer uses a large amount of the organic solvent. To curtail the usage of the organic solvent at the time of the production of the electrophotographic photosensitive member, the amount of the organic solvent to be used in the application liquid for the charge transporting layer is desirably curtailed. However, the production of the application liquid for the charge transporting layer requires the use of a halogen-based solvent or an aromatic organic solvent because a charge transporting substance and a resin each have high solubility in any such solvent. Accordingly, it has been difficult to curtail the usage of the organic solvent.

Patent Literature 1 reports an effort to curtail the amount of an organic solvent in a paint for forming a charge transporting layer for the purposes of reducing a volatile substance and curtailing carbon dioxide. This literature discloses that an emulsion for the charge transporting layer is produced by forming oil droplets of an organic solution, which is prepared by dissolving a substance to be incorporated into the charge transporting layer in an organic solvent, in water.

CITATION LIST

Patent Literature

PTL 1: Japanese Patent Application Laid-Open No. 2011-128213

SUMMARY OF INVENTION

Technical Problem

As a result of investigations conducted by the inventors of the present invention, however, in a method of producing an electrophotographic photosensitive member involving producing the emulsion disclosed in Patent Literature 1, reduction in liquid properties of the emulsion was observed after the emulsion had been left to stand still for a long time period, though a uniform emulsion state was observed immediately after the production of the emulsion.

This may be because of the following reason. The organic solution prepared by dissolving the substance to be incorporated into the charge transporting layer in the organic solvent coalesced in water after a lapse of time to make it difficult to form a stable oil droplet state, and hence the solution agglomerated and sedimented. An additional improvement in terms of compatibility between the curtailment of the usage of the organic solvent and the securement of the stability of the application liquid for the charge transporting layer has been demanded.

In view of the foregoing, the present invention is directed to providing a method of producing an electrophotographic photosensitive member, in particular, a method of producing an electrophotographic photosensitive member by which, in a method of forming a charge transporting layer, the stability of an application liquid for a charge transporting layer after its long-term storage is improved while the usage of an organic solvent to be used in the application liquid is curtailed and hence a charge transporting layer having high uniformity can be formed. The present invention is also directed to providing a method of producing an organic device. In addition, the present invention is directed to providing an application liquid (emulsion) for a charge transporting layer having high stability after its long-term storage.

Solution to Problem

The objects described above are attained by the present invention described below.

The present invention provides a method of producing an electrophotographic photosensitive member which includes a support and a charge transporting layer formed thereon, the method including the steps of:

preparing a solution including:

a first liquid whose solubility in water under 25° C. and 1 atmosphere is 1.0 mass % or less;

a second liquid whose solubility in water under 25° C. and 1 atmosphere is 5.0 mass % or more;

a charge transporting substance; and a binder resin;

preparing an emulsion by dispersing the solution in water;

forming a coat for the charge transporting layer by using the emulsion; and forming the charge transporting layer by heating of the coat.

The present invention also provides a method of producing an organic device, including forming the charge transporting layer through the above-described steps.

The present invention also provides an emulsion for a charge transporting layer, including a solution dispersed in water, in which the solution includes: a first liquid whose solubility in water under 25° C. and 1 atmosphere is 1.0 mass % or less; a second liquid whose solubility in water under 25° C. and 1 atmosphere is 5.0 mass % or more; a charge transporting substance; and a binder resin.

Advantageous Effects of Invention

As described above, according to the present invention, there is provided the method of producing an electrophotographic photosensitive member and the method of producing an organic device, in each of which, the stability of the emulsion after its long-term storage is improved and the charge transporting layer having high uniformity is formed. Further, according to the present invention, provided is the emulsion for a charge transporting layer having high stability after its long-term storage.

Further features of the present invention will become apparent from the following description of exemplary embodiments with reference to the attached drawing.

BRIEF DESCRIPTION OF DRAWINGS

FIGURE is a view illustrating an example of the schematic construction of an electrophotographic apparatus including a process cartridge having an electrophotographic photosensitive member of the present invention.

DESCRIPTION OF EMBODIMENTS

Preferred embodiments of the present invention will now be described in detail in accordance with the accompanying drawings.

A method of producing an electrophotographic photosensitive member of the present invention includes the steps of: preparing a solution containing a first liquid whose solubility in water under 25° C. and 1 atmosphere is 1.0 mass % or less, a second liquid whose solubility in water under 25° C. and 1 atmosphere is 5.0 mass % or more, a charge transporting substance, and a binder resin, followed by the dispersion of the solution in water to prepare an emulsion; and forming a coat of the emulsion on the support, followed by the heating of the coat to form the charge transporting layer.

It is preferred that the second liquid be at least one kind selected from the group consisting of tetrahydrofuran, dimethoxymethane, 1,2-dioxane, 1,3-dioxane, 1,4-dioxane, 1,3,5-trioxane, methanol, 2-pentanone, ethanol, tetrahydropyran, diethylene glycol dimethyl ether, ethylene glycol dimethyl ether, propylene glycol n-butyl ether, propylene glycol monopropyl ether, ethylene glycol monomethyl ether, diethylene glycol monoethyl ether, ethylene glycol monoisopropyl ether, ethylene glycol monobutyl ether, ethylene glycol monoisobutyl ether, ethylene glycol monoallyl ether, propylene glycol monomethyl ether, dipropylene glycol monomethyl ether, tripropylene glycol monomethyl ether, propylene glycol monobutyl ether, propylene glycol monomethyl ether acetate, diethylene glycol methyl ethyl ether, diethylene glycol diethyl ether, dipropylene glycol dimethyl ether, propylene glycol diacetate, methyl acetate, ethyl acetate, n-propyl alcohol, 3-methoxybutanol, 3-methoxybutyl acetate, and ethylene glycol monomethyl ether acetate.

Hereinafter, the production method of the present invention and materials for constituting the electrophotographic photosensitive member are described.

The charge transporting substance in the present invention is a substance having hole transporting performance, and examples thereof include a triarylamine compound, a hydrazone compound, a butadiene compound, and an enamine compound. Of those, a triarylamine compound is preferably used as the charge transporting substance in terms of improvements in electrophotographic characteristics.

Specific examples of the charge transporting substance are shown below, but the charge transporting substance in the present invention is not limited thereto.

(1-1)

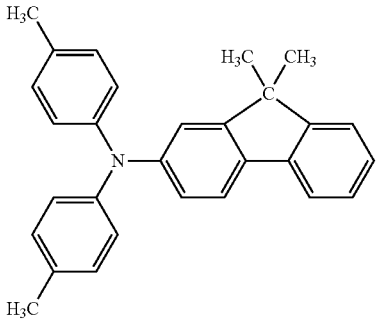

(1-2)

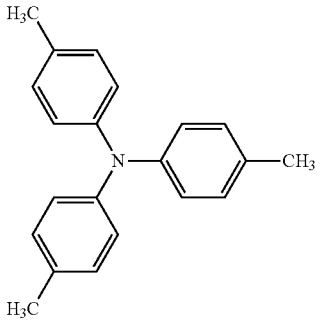

(1-3)

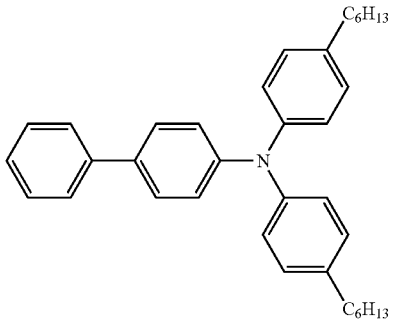

(1-4)

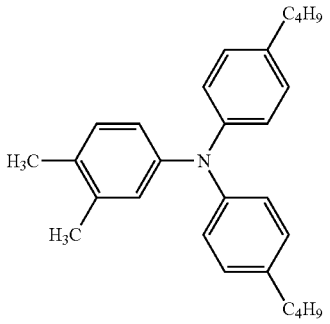

-continued
(1-5)
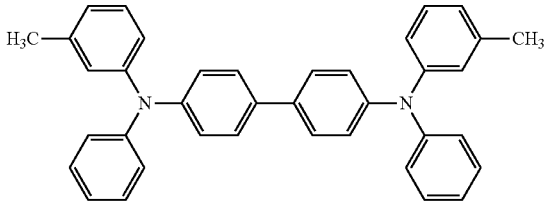
(1-6)
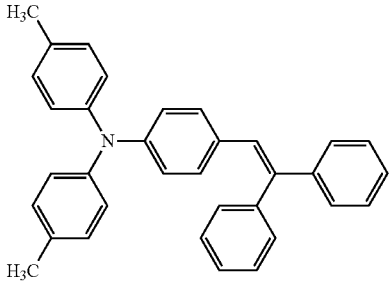
(1-7)
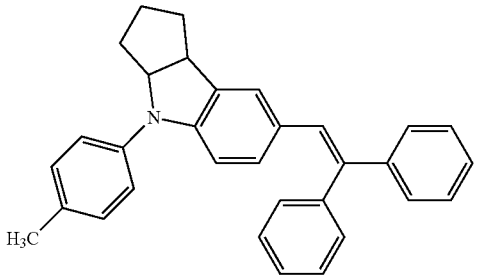
(1-8)
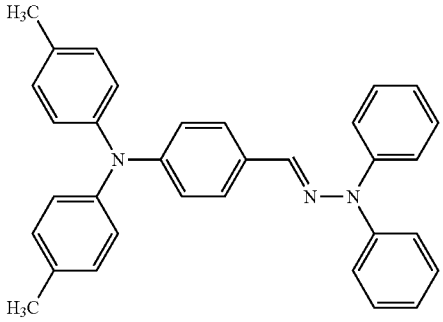
(1-9)
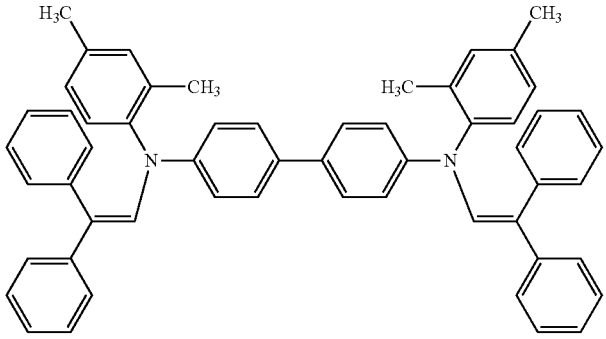
(1-10)
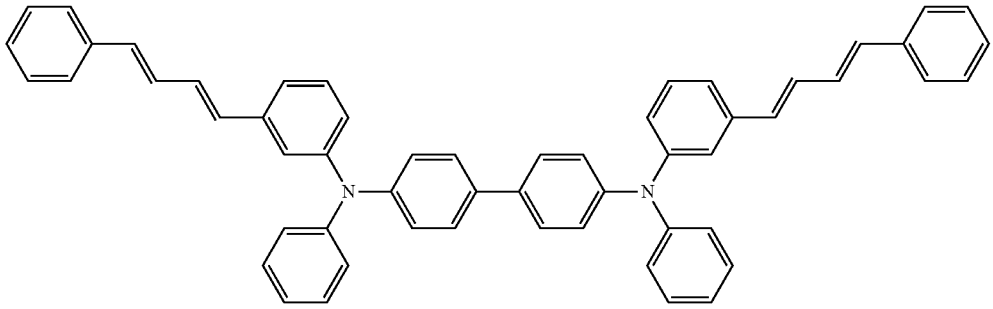

Examples of the binder resin constituting the charge transporting layer include a styrene resin, an acrylic resin, a polycarbonate resin, and a polyester resin. Of those, a polycarbonate resin or a polyester resin is preferred. A polycarbonate resin having a repeating structural unit represented by the following formula (2) or a polyester resin having a repeating structural unit represented by the following formula (3) is more preferred.

(2)

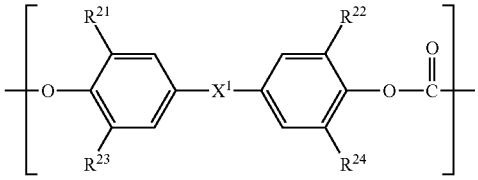

(In the formula (2): $R^{21}$ to $R^{24}$ each independently represent a hydrogen atom or a methyl group; and $X^1$ represents a single bond, a methylene group, an ethylidene group, a propylidene group, a phenylethylidene group, a cyclohexylidene group, or an oxygen atom.)

(3)

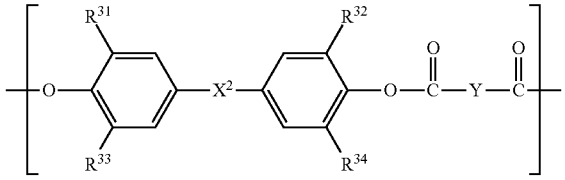

(In the formula (3): $R^{31}$ to $R^{34}$ each independently represent a hydrogen atom or a methyl group; $X^2$ represents a single bond, a methylene group, an ethylidene group, a propylidene group, a cyclohexylidene group, or an oxygen atom; and Y represents an m-phenylene group, a p-phenylene group, or a divalent group having two p-phenylene groups bonded via an oxygen atom.

Specific examples of the polycarbonate resin and the polyester resin are given below.

(2-1)

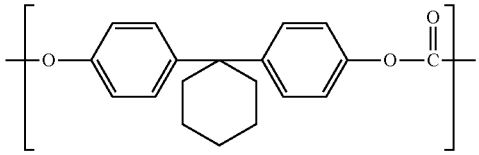

(2-2)

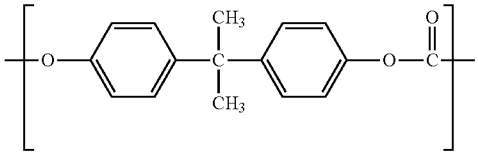

(2-3)

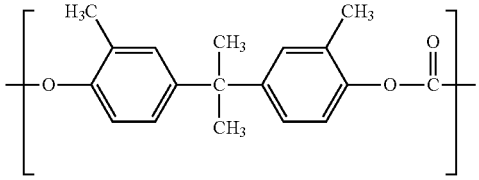

(2-4)

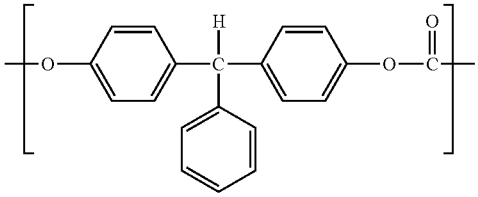

(2-5)

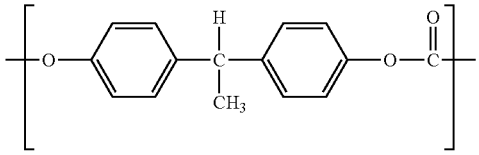

(2-6)

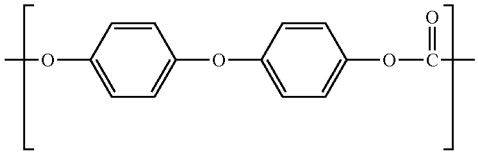

(2-7)

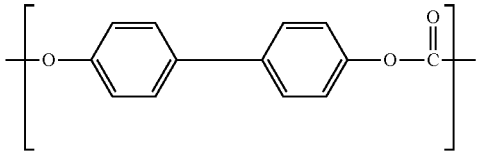

(2-8)

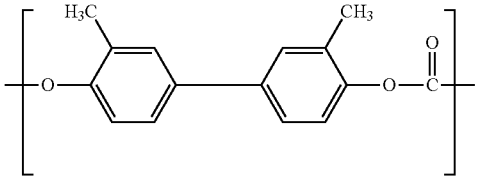

(3-1)

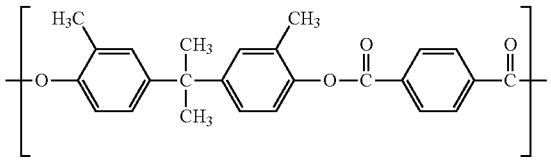

(3-2)

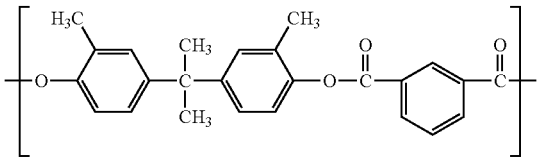

-continued (3-3)

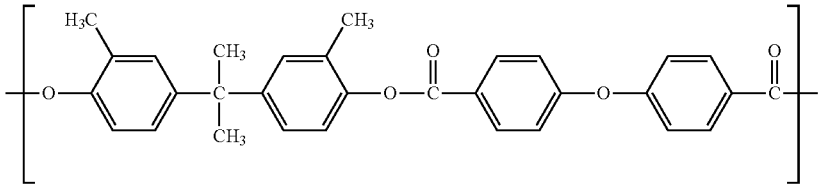

(3-4)

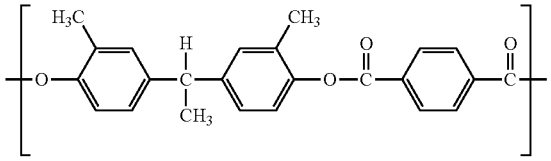

(3-5)

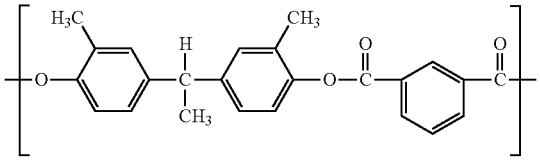

(3-6)

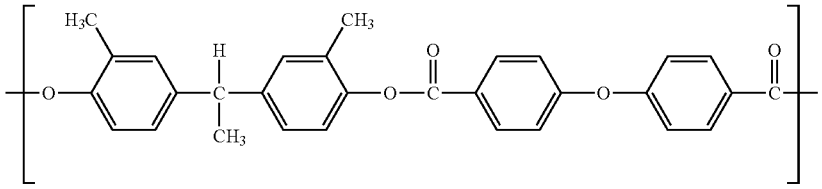

In the present invention, the weight-average molecular weight of the binder resin is a weight-average molecular weight in terms of polystyrene measured according to a conventional method, specifically, by a method described in Japanese Patent Application Laid-Open No. 2007-79555.

In addition to the charge transporting substance and the binder resin, an additive may be incorporated into the charge transporting layer. Examples of the additive constituting the charge transporting layer include an antidegradant such as an antioxidant, a UV absorber, or a light stabilizer, and releasability-providing resins. Examples of the antidegradant include a hindered phenol-based antioxidant, a hindered amine-based light stabilizer, a sulfur atom-containing antioxidant, and a phosphorus atom-containing antioxidant. Examples of releasability-providing resins include a fluorine atom-containing resin and a resin containing a siloxane structure.

The charge transporting substance and the binder resin are each soluble in the first liquid or the second liquid. The first liquid is a hydrophobic liquid whose solubility in water under 25° C. and 1 atmosphere is 1.0 mass % or less, and the second liquid is a hydrophilic liquid whose solubility in water under 25° C. and 1 atmosphere is 5.0 mass % or more. The second liquid is more preferably a hydrophilic liquid whose solubility in water under 25° C. and 1 atmosphere is 20.0 mass % or more.

Hereinafter, Table 1 shows representative examples of the hydrophobic liquid as the first liquid and Table 2 shows representative examples of the hydrophilic liquid as the second liquid, but the first liquid and the second liquid in the present invention are not limited thereto. In addition, the term "aqueous solubility" in each of Tables 1 and 2 refers to a solubility in water under 25° C. and 1 atmosphere (atmospheric pressure) represented in a mass % unit.

TABLE 1

Representative examples of first liquid

| No. | Name | Aqueous solubility |
|---|---|---|
| 1 | Toluene | 0.1 mass % |
| 2 | Chloroform | 0.8 mass % |
| 3 | o-Dichlorobenzene | 0.0 mass % |
| 4 | Chlorobenzene | 0.1 mass % |
| 5 | o-Xylene | 0.0 mass % |
| 6 | Ethylbenzene | 0.0 mass % |
| 7 | Phenetole | 0.1 mass % |

Of the hydrophobic liquids each serving as the first liquid, solvents each having an aromatic ring structure are preferred. Of the solvents, at least one of toluene and xylene is more preferred from the viewpoint of the stability of the emulsion.

Two or more kinds of the first liquids as hydrophobic liquids may be used as a mixture.

TABLE 2

Representative examples of second liquid

| No | Name | Aqueous solubility |
|---|---|---|
| 1 | Tetrahydrofuran | 100.0 mass % or more |
| 2 | Dimethoxymethane | 32.3 mass % |
| 3 | 1,2-Dioxane | 100.0 mass % or more |
| 4 | 1,3-Dioxane | 100.0 mass % or more |
| 5 | 1,4-Dioxane | 100.0 mass % or more |
| 6 | 1,3,5-Trioxane | 21.1 mass % |
| 7 | Methanol | 100.0 mass % or more |
| 8 | 2-Pentanone | 5.9 mass % |
| 9 | Ethanol | 100.0 mass % or more |
| 10 | Tetrahydropyran | 100.0 mass % or more |
| 11 | Diethylene glycol dimethyl ether | 100.0 mass % or more |
| 12 | Ethylene glycol dimethyl ether | 100.0 mass % or more |
| 13 | Propylene glycol n-butyl ether | 6.0 mass % |
| 14 | Propylene glycol monopropyl ether | 100.0 mass % or more |
| 15 | Ethylene glycol monomethyl ether | 100.0 mass % or more |
| 16 | Diethylene glycol monoethyl ether | 100.0 mass % or more |
| 17 | Ethylene glycol monoisopropyl ether | 100.0 mass % or more |

TABLE 2-continued

Representative examples of second liquid

| No | Name | Aqueous solubility |
|---|---|---|
| 18 | Ethylene glycol monobutyl ether | 100.0 mass % or more |
| 19 | Ethylene glycol monoisobutyl ether | 100.0 mass % or more |
| 20 | Ethylene glycol monoallyl ether | 100.0 mass % or more |
| 21 | Propylene glycol monomethyl ether | 100.0 mass % or more |
| 22 | Dipropylene glycol monomethyl ether | 100.0 mass % or more |
| 23 | Tripropylene glycol monomethyl ether | 100.0 mass % or more |
| 24 | Propylene glycol monobutyl ether | 6.4 mass % |
| 25 | Propylene glycol monomethyl ether acetate | 20.5 mass % |
| 26 | Diethylene glycol methyl ethyl ether | 100.0 mass % or more |
| 27 | Diethylene glycol diethyl ether | 100.0 mass % or more |
| 28 | Dipropylene glycol dimethyl ether | 37.0 mass % |
| 29 | Propylene glycol diacetate | 7.4 mass % |
| 30 | Methyl acetate | 19.6 mass % |
| 31 | Ethyl acetate | 8.3 mass % |
| 32 | n-Propyl alcohol | 100.0 mass % or more |
| 33 | 3-methoxybutanol | 100.0 mass % or more |
| 34 | 3-Methoxybutyl acetate | 6.5 mass % |
| 35 | Ethylene glycol monomethyl ether acetate | 100.0 mass % or more |

Of the hydrophilic liquids each serving as the second liquid, ether-based solvents are preferred. Of the solvents, at least one of tetrahydrofuran and dimethoxymethane is more preferred from the viewpoint of the stability of the emulsion.

Two or more kinds of the second liquids as hydrophilic liquids may be used as a mixture. In particular, when the coat of the emulsion is formed on the support by dip coating in the step of applying the coat onto the support to be described later, a hydrophilic liquid having a relatively low boiling point, specifically, a boiling point of 100° C. or less is more preferably used from the viewpoint of film uniformity because a dispersion medium is quickly removed in the step of forming a film by heating.

With regard to a ratio between the first liquid and the second liquid, a ratio (a/b) of the mass of the first liquid (a) to the mass of the second liquid (b) is preferably 1/9 to 9/1. Further, with regard to the ratio of the first liquid and the second liquid, the percentage of the second liquid is more preferably the higher because, in the step of preparing the emulsion to be described later, an oil droplet is reduced in diameter when emulsified and hence the emulsion is additionally stable. The ratio of the charge transporting substance and the binder resin in the solution of the first liquid and the second liquid preferably falls within such a range that the charge transporting substance and the binder resin dissolve to provide a solution, and that the solution has a proper viscosity at the time of emulsion from the viewpoint of the preparation of a stable emulsion. More specifically, the charge transporting substance and the binder resin are preferably dissolved at a ratio in the range of 10 mass % or more and 50 mass % or less in the solution of the first liquid and the second liquid. In addition, the viscosity of the solution in which the charge transporting substance and the binder resin have been dissolved preferably falls within the range of 50 mPa·s or more and 500 mPa·s or less.

Next, a method of preparing the emulsion with the solution prepared by the foregoing method and water is described.

An existing emulsification method may be employed as an emulsification method of preparing the emulsion. In addition, the emulsion contains at least the charge transporting substance and the binder resin in a state where the substance and the resin are at least partially dissolved in an emulsified particle. A stirring method and a high-pressure impact method are described below as specific emulsification methods, but the production method of the present invention is not limited thereto.

The stirring method is described. The charge transporting substance and the binder resin are dissolved in the first liquid and the second liquid to prepare a solution, and then the solution is weighed. After that, water as a dispersion medium is weighed, and then the solution and the water are mixed. After that, the mixture is stirred with a stirring machine. Here, the water to be used as the dispersion medium is preferably ion-exchanged water obtained by removing a metal ion and the like with an ion exchange resin or the like from the viewpoints of electrophotographic characteristics. The conductivity of the ion-exchanged water is preferably 5 μS/cm or less. The stirring machine is preferably a stirring machine capable of high-speed stirring because the solution can be uniformly dispersed in a short time period. Examples of the stirring machine include a homogenizer "PHYSCOTRON" manufactured by MICROTEC CO., LTD., and a circulating homogenizer "CLEARMIX" manufactured by M Technique Co., Ltd.

The high-pressure impact method is described. In the method, the emulsion can be prepared by: dissolving the charge transporting substance and the binder resin in the first liquid and the second liquid to prepare a solution; weighing the solution; weighing water as a dispersion medium; mixing the solution and the water; and causing the contents of the mixed liquid to impact with each other under high pressure. Alternatively, the emulsion may be prepared by causing the solution and the water as different liquids to impact with each other without mixing the liquids. A dispersing apparatus to be used in the method is, for example, a "Microfluidizer M-110EH" manufactured by Microfluidics in the U.S., or a "Nanomizer YSNM-2000AR" manufactured by YOSHIDA KIKAI CO., LTD.

A ratio (w/(a+b+ct+r)) of the mass of the water (w) to the total (a+b+ct+r) of the mass of the charge transporting substance (ct), the mass of the binder resin (r), the mass of the first liquid (a), and the mass of the second liquid (b) in the emulsion is preferably 3/7 to 8/2, more preferably 5/5 to 7/3 from the viewpoint of the stability of the emulsion. In addition, with regard to the ratio of the water and the organic solvents, the percentage of the water is preferably the higher from such a viewpoint that an oil droplet is reduced in diameter when emulsified and the emulsion is stable. Accordingly, the ratio can be adjusted so that an oil droplet may be reduced in diameter and the stability of the emulsion may be additionally improved to such an extent that the charge transporting substance and the binder resin dissolve in the organic solvents.

The ratio of the charge transporting substance and the binder resin in an oil droplet is preferably 10 to 50 mass % with respect to the organic solvents. A ratio between the charge transporting substance and the binder resin falls within the range of preferably 4:10 to 20:10 (mass ratio), more preferably 5:10 to 12:10 (mass ratio). The ratio between the charge transporting substance and the binder resin is adjusted so as to be such ratio. In addition, when the additive is further added to the charge transporting substance and the binder resin, its content is preferably 50 mass % or less, more preferably 30 mass % or less with respect to the solid content ratio of the charge transporting substance and the binder resin.

In addition, a surfactant may be incorporated into the emulsion of the present invention for the purpose of additionally stabilizing its emulsification. The surfactant is preferably a nonionic surfactant from the viewpoint of suppressing the deterioration of the electrophotographic characteristics. The nonionic surfactant is, for example, a surfactant whose hydrophilic portion is a nonelectrolyte, in other words, a surfactant having a hydrophilic portion that does not ionize, and specific examples thereof include a series of nonionic surfactants out of: a NOIGEN series manufactured by DAI-ICHI KOGYO SEIYAKU CO., LTD.; a NAROACTY series, an EMULMIN series, a SANNONIC series, and a NEWPOL series manufactured by Sanyo Chemical Industries, Ltd.; an EMULGEN series, a RHEODOL series, and an EMANON series manufactured by Kao Corporation; an ADEKA TOL series, an ADEKA ESTOL series, and an ADEKA NOL series manufactured by ADEKA CORPORATION; and a NEWCOL series manufactured by NIPPON NYUKAZAI CO., LTD. One kind of those surfactants may be used alone, or two or more kinds thereof may be used in combination. In addition, a surfactant having a hydrophilic-lipophilic balance (HLB) in the range of 8 to 15 is preferably selected for the stability of the emulsion.

The addition amount of the surfactant is preferably as small as possible from such a viewpoint that the electrophotographic characteristics are not deteriorated, and its content in the emulsion falls within the range of preferably 0 mass % to 1.5 mass %, more preferably 0 mass % to 0.5 mass %. In addition, the surfactant may be added to the water as a dispersion medium in advance, or may be added to the organic solvents in which the charge transporting substance and the binder resin have been dissolved. Alternatively, the surfactant may be added to each of both the water and the organic solvents before the emulsification. In the present invention, the incorporation of not a hydrophobic organic solvent alone but both hydrophobic and hydrophilic organic solvents has significantly improved the stability of the emulsion as compared with that in the case where an emulsion is produced with the hydrophobic organic solvent alone. The reason for the foregoing is described later. In addition, the emulsion for a charge transporting layer may contain an additive such as a defoaming agent or a viscoelasticity modifier to such an extent that an effect of the present invention is not impaired.

The average particle diameter of the emulsified particles prepared as described above preferably falls within the range of 0.1 to 20.0 μm, and more preferably falls within the range of 0.1 to 5.0 μm from the viewpoint of the stability of the emulsion.

Next, a method of applying the coat of the emulsion prepared by the foregoing method onto the support is described.

With regard to a method involving applying the emulsion to form the coat of the emulsion on the support, any one of the existing application methods such as a dip coating method, a ring coating method, a spray coating method, a spinner coating method, a roller coating method, a Meyer bar coating method, and a blade coating method is adaptable. Of those, dip coating is preferred from the viewpoint of productivity. The emulsion of the present invention can be applied onto the support by the step.

Next, a method of heating the coat applied onto the support by the foregoing method is described.

The charge transporting layer is formed on the support by heating the coat formed by the step of forming the coat.

In the present invention, the emulsion containing at least the charge transporting substance and the binder resin is applied. Accordingly, the following is preferred from the viewpoint of the formation of a coat having high uniformity. The emulsion is formed into a film in an additionally uniform fashion by bringing emulsified particles into close contact with each other simultaneously with the removal of the dispersion medium by the heating step. Accordingly, the particle diameters of the emulsified particles are preferably reduced in an additional fashion because a thickness distribution having high uniformity is obtained quickly after the removal of the dispersion medium. A temperature for the heating is preferably 100° C. or more. Further, the heating temperature is preferably equal to or higher than the melting point of a charge transporting substance having the lowest melting point out of the charge transporting substances constituting the charge transporting layer in terms of an improvement in adhesiveness between the emulsified particles. The charge transporting substance is melted by the heating at a temperature equal to or higher than the melting point of the charge transporting substance, and then the binder resin dissolves in the melt of the charge transporting substance. As a result, a coat having high uniformity can be formed. Further, with regard to the heating temperature, the heating is preferably performed at a temperature higher than the melting point of the charge transporting substance having the lowest melting point out of the charge transporting substances constituting the charge transporting layer by 5° C. or more. In addition, the heating temperature is preferably 200° C. or less because an excessively high heating temperature causes the denaturation or the like of the charge transporting substance.

The thickness of the charge transporting layer produced by the production method of the present invention is preferably 3 μm or more and 50 μm or less, more preferably 5 μm or more and 35 μm or less.

In the present invention, the solution containing the charge transporting substance and the binder resin is prepared with the organic solvents containing both the hydrophobic and hydrophilic solvents, and then the emulsion is prepared by dispersing the solution in water. Accordingly, even when the emulsion is stored for a long time period, the agglomeration of the emulsion is suppressed, which is a result advantageous in terms of productivity. In a method involving preparing a solution containing the charge transporting substance and the binder resin with the hydrophobic organic solvent alone, and then forming an emulsion in water, substances constituting the charge transporting layer such as the charge transporting substance and the binder resin are present in an oil droplet formed of the solution present in water, but the oil droplet is formed so as to contain a large amount of the organic solvent. Accordingly, the agglomeration (coalescence) of the oil droplets is liable to occur after long-term storage of the emulsion. Although the incorporation of a large amount of a surfactant can extend the time period for which a state where the solution is dispersed is maintained, it is difficult to maintain an oil droplet state. In the present invention, in the production method of preparing the emulsion including dissolving the charge transporting substance and the binder resin with the organic solvents containing both the hydrophobic and hydrophilic solvents, and then dispersing the solution in water to prepare the emulsion, the hydrophilic organic solvent in an oil droplet quickly migrates toward an aqueous phase side and hence the oil droplet becomes additionally small, and the concentration of each of the charge transporting substance and the binder resin in the oil droplet increases. As a result, an emulsified particle adopts a form close to a fine particle of a solid and hence the occurrence of the agglomeration of oil droplets can be significantly suppressed as compared with that in the case where an emulsion is prepared with the hydrophobic solvent alone. It is also conceivable that the hydrophilic organic solvent in the organic solvents has such amphipathic property as to dissolve in both water and oil, and hence the solvent serves like a surfactant in an oil droplet particle to suppress the agglomeration (coalescence) of the oil droplets. As a result, the dispersed state can be maintained even after the long-term storage of the emulsion.

Next, the construction of an electrophotographic photosensitive member produced by the method of producing an electrophotographic photosensitive member of the present invention is described.

As described above, the method of producing an electrophotographic photosensitive member of the present invention is a method of producing an electrophotographic photosensitive member having a support, and a charge generating layer and a charge transporting layer on the support.

In general, as the electrophotographic photosensitive member, a cylindrical electrophotographic photosensitive member produced by forming a photosensitive layer on a cylindrical support is widely used, but the member may be formed into a belt or sheet shape.

The support has preferably electro-conductivity (conductive support) and a support made of a metal or an alloy such as aluminum, an aluminum alloy, or stainless steel may be used. In the case of a support made of aluminum or an aluminum alloy, the support to be used may be an ED tube or an EI tube or one obtained by subjecting the tube to cutting, electrochemical buffing, or a wet- or dry-honing process. Further, a support made of a metal or a support made of a resin having layer obtained by forming aluminum, an aluminum alloy, or an indium oxide-tin oxide alloy into a film by means of vacuum deposition may be used. In addition, a support obtained by impregnating conductive particles such as carbon black, tin oxide particles, titanium oxide particles, or silver particles in a resin or the like, or a plastic having an conductive resin may be used.

The surface of the support may be subjected to, for example, cutting treatment, roughening treatment, or alumite treatment.

An conductive layer may be provided between the support and an intermediate layer or a charge generating layer to be described later. The conductive layer is formed through the use of an application liquid for the conductive layer, which is prepared by dispersing conductive particles in a resin. Examples of the conductive particles include carbon black, acetylene black, metal or alloy powders made of, for example, aluminum, nickel, iron, nichrome, copper, zinc, and silver, and metal oxide powders made of, for example, conductive tin oxide and ITO.

In addition, examples of the resin include a polyester resin, a polycarbonate resin, a polyvinyl butyral resin, an acrylic resin, a silicone resin, an epoxy resin, a melamine resin, a urethane resin, a phenol resin, and an alkyd resin.

As a solvent to be used for the application liquid for the conductive layer, there are given, for example, an ether-based solvent, an alcohol-based solvent, a ketone-based solvent, and an aromatic hydrocarbon solvent.

The thickness of the conductive layer is preferably 0.2 μm or more and 40 μm or less, more preferably 1 μm or more and 35 μm or less, still more preferably 5 μm or more and 30 μm or less.

The intermediate layer may be provided between the support or the conductive layer and the charge generating layer.

The intermediate layer can be formed by applying an application liquid for the intermediate layer containing a resin onto the support or the conductive layer and drying or hardening the application liquid.

Examples of the resin in the intermediate layer include polyacrylic acids, methylcellulose, ethylcellulose, a polyamide resin, a polyimide resin, a polyamideimide resin, a polyamide acid resin, a melamine resin, an epoxy resin, a polyurethane resin, and a polyolefin resin. The resin in the intermediate layer is preferably a thermoplastic resin, and specifically, a thermoplastic polyamide resin or a polyolefin resin is preferred. The polyamide resin is preferably copolymer nylon with low crystallinity or no crystallinity which can be applied in a solution state. The polyolefin resin is preferably in a state where the resin can be used as a particle dispersion. It is more preferred that the polyolefin resin be dispersed in an aqueous medium.

The thickness of the intermediate layer is preferably 0.05 μm or more and 7 μm or less, more preferably 0.1 μm or more and 2 μm or less.

The intermediate layer may further contain semiconductive particles, an electron transporting substance, or an electron accepting substance.

The charge generating layer is provided on the support, conductive layer, or intermediate layer.

Examples of the charge generating substance to be used in the electrophotographic photosensitive member of the present invention include azo pigments, phthalocyanine pigments, indigo pigments, and perylene pigments. Only one kind of those charge generating substances may be used, or two or more kinds thereof may be used. Of those, metallophthalocyanines such as oxytitanium phthalocyanine, hydroxygallium phthalocyanine, and chlorogallium phthalocyanine are particularly preferred because of their high sensitivity.

Examples of the binder resin to be used in the charge generating layer include a polycarbonate resin, a polyester resin, a butyral resin, a polyvinyl acetal resin, an acrylic resin, a vinyl acetate resin, and a urea resin. Of those, a butyral resin is particularly preferred. One kind of those resins may be used alone, or two or more kinds thereof may be used as a mixture or as a copolymer.

The charge generating layer can be formed by applying an application liquid for the charge generating layer, which is prepared by dispersing a charge generating substance together with a resin and a solvent, and then drying the application liquid. Further, the charge generating layer may also be a deposited film of a charge generating substance.

Examples of the dispersion method include one using a homogenizer, an ultrasonic wave, a ball mill, a sand mill, an attritor, or a roll mill.

A ratio between the charge generating substance and the resin falls within the range of preferably 1:10 to 10:1 (mass ratio), particularly preferably 1:1 to 3:1 (mass ratio).

The solvent to be used for the application liquid for the charge generating layer is selected depending on the solubility and dispersion stability of each of the resin and charge generating substance to be used. Examples of the solvent include organic solvents such as an alcohol-based solvent, a sulfoxide-based solvent, a ketone-based solvent, an ether-based solvent, an ester-based solvent, and an aromatic hydrocarbon solvent.

The thickness of the charge generating layer is preferably 5 μm or less, more preferably 0.1 μm or more and 2 μm or less.

Further, any of various sensitizers, antioxidants, UV absorbers, plasticizers, and the like may be added to the charge generating layer, if required. An electron transporting substance or an electron accepting substance may also be incorporated into the charge generating layer to prevent the flow of charge from being disrupted in the charge generating layer.

The charge transporting layer is provided on the charge generating layer.

The charge transporting layer is produced by the production method described in the foregoing.

A variety of additives may be added to each layer of the electrophotographic photosensitive member. Examples of the additives include: an antidegradant such as an antioxidant, a UV absorber, or a light stabilizer; and fine particles such as organic fine particles or inorganic fine particles. Examples of the antidegradant include a hindered phenol-based antioxidant, a hindered amine-based light stabilizer, a sulfur atom-containing antioxidant, and a phosphorus atom-containing antioxidant. Examples of the organic fine particles include polymer resin particles such as fluorine atom-containing resin particles, polystyrene fine particles, and polyethylene resin particles. Examples of the inorganic fine particles include metal oxides such as silica and alumina.

For the application of each of the application liquids corresponding to the above-mentioned respective layers, any of the application methods may be employed, such as a dip coating method, a spraying coating method, a spinner coating method, a roller coating method, a Meyer bar coating method, and a blade coating method.

In addition, a hill-and-dale shape (hollow-shaped and/or hill-shaped unevenness) may be formed in the surface of the surface layer of the electrophotographic photosensitive member. An existing method can be adopted as a method of forming the hollow-shaped unevenness. Examples of the forming method include: a method involving spraying the surface with abrasive particles to form the hollow-shaped unevenness; a method involving bringing a mold having the a hill-and-dale shape into press contact with the surface to form the hollow- and hill-shaped unevenness; and a method involving irradiating the surface with laser light to form the hollow-shaped unevenness. Of those, the method involving bringing the mold having the hill-and-dale shape into press contact with the surface of the surface layer of the electrophotographic photosensitive member to form the hollow- and hill-shaped unevenness is preferred.

FIGURE illustrates an example of the schematic construction of an electrophotographic apparatus including a process cartridge having the electrophotographic photosensitive member of the present invention.

In FIGURE, a cylindrical electrophotographic photosensitive member 1 is rotationally driven about an axis 2 in a direction indicated by an arrow at a predetermined peripheral speed.

The surface of the electrophotographic photosensitive member 1 to be rotationally driven is uniformly charged to a positive or negative predetermined potential by charging unit (primary charging unit: a charging roller or the like) 3. Next, the surface receives exposure light (image exposure light) 4 output from exposing unit (not shown) such as slit exposure or laser beam scanning exposure. Thus, electrostatic latent images corresponding to a target image are sequentially formed on the surface of the electrophotographic photosensitive member 1.

The electrostatic latent images formed on the surface of the electrophotographic photosensitive member 1 are developed with toners in the developers of developing unit 5 to provide toner images. Next, the toner images formed and borne on the surface of the electrophotographic photosensitive member 1 are sequentially transferred onto a transfer material (such as paper) P by a transfer bias from transferring unit (such as a transfer roller) 6. It should be noted that the transfer material P is taken out of transfer material-supplying unit (not shown) and fed into a gap between the electrophotographic photosensitive member 1 and the transferring unit 6 (abutting portion) in synchronization with the rotation of the electrophotographic photosensitive member 1.

The transfer material P onto which the toner images have been transferred is separated from the surface of the electrophotographic photosensitive member 1 and then introduced to fixing unit 8. The transfer material P is subjected to image fixation to be printed out as an image-formed product (print or copy) to the outside of the apparatus.

The surface of the electrophotographic photosensitive member 1 after the transfer of the toner images is cleaned by removal of the remaining developer (toner) after the transfer by cleaning unit (such as cleaning blade) 7. Subsequently, the surface of the electrophotographic photosensitive member 1 is subjected to a neutralization process with pre-exposure light (not shown) from pre-exposing unit (not shown) and then repeatedly used in image formation. It should be noted that, as illustrated in FIGURE, when the charging unit 3 is contact-charging unit using a charging roller or the like, the pre-exposure is not always required.

Of the constituents including the electrophotographic photosensitive member 1, the charging unit 3, the developing unit 5, the transferring unit 6, and the cleaning unit 7, a plurality of them may be stored in a container and integrally supported to form a process cartridge. In addition, the process cartridge may be designed so as to be detachably mountable to the main body of an electrophotographic apparatus such as a copying machine or a laser beam printer. In FIGURE, the charging unit 3, the developing unit 5, and the cleaning unit 7 are integrally supported with the electrophotographic photosensitive member 1 to provide a cartridge, and then the cartridge is used as a process cartridge 9 detachably mountable to the main body of the electrophotographic apparatus with a guiding unit 10 such as a rail of the main body of the electrophotographic apparatus.

EXAMPLES

Hereinafter, the present invention is described in more detail with reference to examples and comparative examples. However, the present invention is not limited in any way to the following examples. It should be noted that "part(s)" means "part(s) by mass" in the examples.

Example 1

An emulsion containing a charge transporting substance and a resin was produced by the following method.

Parts of the compound represented by the formula (1-1) and 1 part of the compound represented by the formula (1-5) as charge transporting substances, and 5 parts of a polycarbonate resin having the repeating structure represented by the formula (2-1) (weight-average molecular weight Mw=36,000) as a binder resin were dissolved in a mixed solvent of 20 parts of toluene and 10 parts of dimethoxymethane to prepare an organic solvent liquid for a charge transporting layer (hydrophobic organic solvent/hydrophilic organic solvent=2/1). Next, 40 parts of the organic solvent liquid for a charge transporting layer prepared in the foregoing were gradually added to 60 parts of ion-exchanged water (having a conductivity of 0.2 μS/cm) for 10 minutes while the water was stirred with a homogenizer at 3,000 revolutions/min. Thus, the materials for an emulsion for a charge transporting layer (100 parts) were mixed. Further, the number of revolutions was increased to 7,000 revolutions/min and then the mixture was stirred for an additional twenty minutes. After that, the mixture was emulsified with a high-pressure impact type disperser Nanomizer (manufactured by YOSHIDA KIKAI CO., LTD.) under a pressure condition of 150 MPa. Thus, the emulsion for a charge transporting layer (100 parts) was obtained.

The resultant emulsion was evaluated for its liquid stability as described below. In the evaluation method, after the production of the emulsion by the foregoing method, the emulsion was visually observed and then evaluated for the particle diameters of its emulsified particles. Further, the prepared emulsion was left to stand still for 2 weeks (under an environment having a temperature of 23° C. and a humidity of 50%). The emulsion that had been left to stand still was stirred with a homogenizer PHYSCOTRON manufactured by MICROTEC CO., LTD. at 1,000 revolutions/min for 3 minutes. The state of the emulsion after the stirring was visually observed. In addition, the particle diameters of the emulsified particles were measured by measuring their average particle diameters before the standing and after the stirring with the homogenizer after the standing. It should be noted that, with regard to the measurement of the average particle diameters, the emulsion for a charge transporting layer was diluted with water and then the average particle diameter of the diluted liquid was measured with an ultracentrifugal, automatic particle size distribution measuring apparatus manufactured by HORIBA, Ltd. (CAPA700).

No significant change was found between the states of the emulsion obtained in Example 1 before and after the standing by visual observation. In addition, there was substantially no change between the average particle diameters before and after the standing. Accordingly, a stable emulsion was held. Table 4 shows the results of the evaluation. It should be noted that the evaluation by visual observation before and after the standing was performed in a state where the emulsion was charged into a cell measuring 1 cm by 1 cm after having been diluted with water twofold.

Examples 2 to 39

Emulsions were each produced by the same method as that of Example 1 except that: the kinds and ratios of the charge transporting substances and the binder resin were changed as shown in Table 3; and the ratio of the hydrophobic organic solvent to the hydrophilic organic solvent and the kinds of the organic solvents, and the ratio of water to the organic solvents were changed as shown in Table 4. Table 4 shows the results of the evaluation of the resultant emulsions for their liquid stability.

It should be noted that the melting points of the charge transporting substances used in the examples are as follows.

Formula (1-1): 145° C.
Formula (1-2): 114 to 118° C.
Formula (1-3): 83 to 87° C.
Formula (1-4): 118 to 122° C.
Formula (1-5): 169° C.

Examples 40 to 44

Emulsions were each produced by the same method as that of Example 1 except that: a polycarbonate resin having the repeating structures represented by the formula (2-2) and the formula (2-3) ((2-2)/(2-3)=5/5 (mass ratio), Mw=60,000) was used as a binder resin; the kinds and ratios of the charge transporting substances were changed as shown in Table 3; and the kinds and ratios of the solvents were changed as shown in Table 4. Table 4 shows the results of the evaluation of the resultant emulsions for their liquid stability.

Examples 45 to 49

Emulsions were each produced by the same method as that of Example 1 except that: a polyester resin having the repeating structures represented by the formula (3-1) and the formula (3-2) ((3-1)/(3-2)=5/5 (mass ratio), Mw=90,000) was used as a binder resin; the kinds and ratios of the charge transporting substances were changed as shown in Table 3; and the kinds and ratios of the solvents were changed as shown in Table 4. Table 4 shows the results of the evaluation of the resultant emulsions for their liquid stability.

Examples 50 to 54

Emulsions were each produced by the same method as that of Example 1 except that: a polyester resin having the repeating structure represented by the formula (3-6) (Mw=100,000) was used as a binder resin; the kinds and ratios of the charge transporting substances were changed as shown in Table 3; and the kinds and ratios of the solvents were changed as shown in Table 4. Table 4 shows the results of the evaluation of the resultant emulsions for their liquid stability.

Examples 55 to 78, 159 to 212, and 240 to 242

Emulsions were each produced by the same method as that of Example 1 except that: the kinds and ratios of the charge transporting substances and the binder resin were changed as shown in Table 3; the ratio of the hydrophobic organic solvent to the hydrophilic organic solvent and the kinds of the organic solvents, and the ratio of water to the organic solvents were changed as shown in Table 4; and a surfactant was added in an amount shown in Table 4 to water. Table 4 shows the results of the evaluation of the resultant emulsions for their liquid stability. Here, the addition amount of the surfactant is represented as a ratio with respect to the entirety of an emulsion in a mass % unit.

It should be noted that the kinds of the surfactants used in the examples are as follows.

NOIGEN EA-167 (manufactured by DAI-ICHI KOGYO SEIYAKU CO., LTD., HLB=14.8) in Examples 55 to 58, 67 to 70, 186 to 212, and 240 to 242

NAROACTY CL-85 (manufactured by Sanyo Chemical Industries, Ltd., HLB=12.6) in Examples 59 to 62 and 71 to 74

EMULGEN MS-110 (manufactured by Kao Corporation, HLB=12.7) in Examples 63 to 66 and 75 to 78

Comparative Example 1

An application liquid containing a charge transporting substance and a binder resin was produced by the following method based on the method described in Patent Literature 1.

Parts of the compound represented by the formula (1-5) as a charge transporting substance and 5 parts of a polycarbonate resin having the repeating structure represented by the formula (2-1) (Mw=36,000) as a binder resin were dissolved in 40 parts of toluene to produce a solution for a charge transporting layer (50 parts). Next, a NAROACTY CL-85 (1.5 parts) was added as a surfactant to 48.5 parts by mass of water, and then the solution for a charge transporting layer (50 parts by mass) was added to the mixture while the mixture was stirred with a homogenizer at a speed of 3,000 revolutions/min, followed by stirring for 10 minutes. Further, the number of revolutions was increased to 7,000 revolutions/min and then the mixture was stirred for 20 minutes. After that, the mixture was emulsified with a high-pressure impact type disperser Nanomizer (manufactured by YOSHIDA KIKAI CO., LTD.) under a pressure condition of 150 MPa. Thus, an emulsion for a charge transporting layer (100 parts) was obtained.

The emulsified application liquid for a charge transporting layer thus obtained was evaluated for its liquid stability.

In the evaluation method, the emulsion for a charge transporting layer produced by the foregoing method was left to stand still for 2 weeks (under an environment having a temperature of 23° C. and a humidity of 50%). The emulsion for a charge transporting layer that had been left to stand still was stirred with a homogenizer at 1,000 revolutions/min for 3 minutes. The state of the dispersion (emulsion) after the stirring with the homogenizer was visually observed. The average particle diameters of the emulsion before the standing and after the stirring with the homogenizer after the standing were measured by the same method as that of Example 1. Table 6 shows the results. It should be noted that the evaluation by visual observation before and after the standing was performed in a state where the emulsion was charged into a cell measuring 1 cm by 1 cm after having been diluted with water twofold.

The emulsified application liquid for a charge transporting layer obtained in Comparative Example 1 after the standing was in such a state that the sedimentation of an oil droplet component was observed and an agglomerate was observed at a bottom surface owing to the coalescence of part of the oil droplet components. The emulsion for a charge transporting layer after the stirring could not form a state of an application liquid having high uniformity because the agglomeration of the oil droplet components was observed unlike the emulsion immediately after the production of the emulsion.

Comparative Example 2

An emulsion for a charge transporting layer was produced by the same method as that of Comparative Example 1 except that: the compound represented by the formula (1-3) was used as a charge transporting substance; and o-xylene was used as an organic solvent. The resultant emulsion for a charge transporting layer was evaluated for its stability by the same method as that of Comparative Example 1. Table 6 shows the results.

Comparative Example 3

An emulsion for a charge transporting layer was produced by the same method as that of Comparative Example 1 except that: the amount of toluene as the organic solvent was changed to 30 parts; and 58.5 parts of water were used. The resultant emulsion for a charge transporting layer was evaluated for its stability by the same method as that of Comparative Example 1. Table 6 shows the results.

Comparative Example 4

An emulsion for a charge transporting layer was produced by the same method as that of Comparative Example 2 except that: the amount of o-xylene as the organic solvent was changed to 30 parts; and 58.5 parts of water were used. The resultant emulsion for a charge transporting layer was evaluated for its stability by the same method as that of Comparative Example 1. Table 6 shows the results.

Comparative Example 5

An attempt was made to produce an emulsion for a charge transporting layer by the same method as that of Comparative Example 1 except that: the amount of toluene as the organic solvent was changed to 20 parts; and 68.5 parts of water were used. The resultant mixture formed an emulsified state immediately after the stirring with the homogenizer. However, the agglomeration of oil droplets was observed, and after long-term storage, the mixture readily separated into an oil phase and an aqueous phase even when stirred with the homogenizer again. Accordingly, an emulsion for a charge transporting layer could not be produced.

Comparative Example 6

An attempt was made to produce an emulsion for a charge transporting layer by the same method as that of Comparative Example 2 except that: the amount of o-xylene as the organic solvent was changed to 20 parts; 68.5 parts of water were used; and the charge transporting substance was changed as shown in Table 5. The resultant mixture formed an emulsified state immediately after the stirring with the homogenizer. However, the agglomeration of oil droplets was observed, and after long-term storage, the mixture readily separated into an oil phase and an aqueous phase even when stirred with the homogenizer again. Accordingly, an emulsion for a charge transporting layer could not be produced.

Comparative Example 7

An attempt was made to produce an emulsion for a charge transporting layer by the same method as that of Comparative Example 1 except that: the amount of ethylbenzene as the organic solvent was changed to 30 parts; 60 parts of water were used; and no surfactant was added. However, the resultant mixture readily separated into an oil phase and an aqueous phase even immediately after the stirring with the homogenizer. Accordingly, an emulsion for a charge transporting layer could not be produced.

Comparative Example 8

An emulsion for a charge transporting layer was produced by the same method as that of Comparative Example 1 except that: 20 parts of toluene and 10 parts of dipropylene glycol monobutyl ether (whose solubility in water under 25° C. and 1 atmosphere (atmospheric pressure) was 3.0 mass %) were used as organic solvents; and 58.5 parts of water were used. The resultant emulsion for a charge transporting layer was evaluated for its stability by the same method as that of Comparative Example 1. Table 6 shows the results.

Comparative Example 9

An emulsion for a charge transporting layer was produced by the same method as that of Comparative Example 8 except that diethylene glycol monophenyl ether (whose solubility in water under 25° C. and 1 atmosphere (atmospheric pressure) was 3.4 mass %) was used instead of dipropylene glycol monobutyl ether used in Comparative Example 8. The resultant emulsion for a charge transporting layer was evaluated for its stability by the same method as that of Comparative Example 1. Table 6 shows the results.

Comparative Example 10

An emulsion for a charge transporting layer was produced by the same method as that of Comparative Example 8 except that 1,4-butanediol diacetate (whose solubility in water under 25° C. and 1 atmosphere (atmospheric pressure) was 4.2 mass %) was used instead of dipropylene glycol monobutyl ether used in Comparative Example 8. The resultant emulsion for a charge transporting layer was evaluated for its stability by the same method as that of Comparative Example 1. Table 6 shows the results.

TABLE 3

| | Charge transporting substance | | CT1/CT2 | Binder | (CT1 + CT2)/B |
|---|---|---|---|---|---|
| | CT1 | CT2 | ratio | resin | ratio |
| Example 1 | (1-1) | (1-5) | 8/2 | (2-1) | 10/10 |
| Example 2 | (1-1) | (1-5) | 8/2 | (2-1) | 10/10 |
| Example 3 | (1-1) | (1-5) | 8/2 | (2-1) | 10/10 |
| Example 4 | (1-1) | (1-5) | 8/2 | (2-1) | 10/10 |
| Example 5 | (1-1) | (1-5) | 8/2 | (2-1) | 10/10 |
| Example 6 | (1-1) | (1-5) | 8/2 | (2-1) | 10/10 |
| Example 7 | (1-1) | (1-5) | 8/2 | (2-1) | 10/10 |
| Example 8 | (1-1) | (1-5) | 8/2 | (2-1) | 10/10 |
| Example 9 | (1-1) | (1-5) | 8/2 | (2-1) | 10/10 |
| Example 10 | (1-1) | (1-5) | 8/2 | (2-1) | 10/10 |
| Example 11 | (1-1) | (1-5) | 8/2 | (2-1) | 10/10 |
| Example 12 | (1-1) | (1-5) | 8/2 | (2-1) | 10/10 |
| Example 13 | (1-1) | (1-5) | 8/2 | (2-1) | 10/10 |
| Example 14 | (1-1) | (1-5) | 8/2 | (2-1) | 10/10 |
| Example 15 | (1-1) | (1-5) | 8/2 | (2-1) | 10/10 |
| Example 16 | (1-1) | (1-5) | 8/2 | (2-1) | 10/10 |
| Example 17 | (1-1) | (1-5) | 8/2 | (2-1) | 10/10 |
| Example 18 | (1-1) | (1-5) | 9/1 | (2-1) | 10/10 |
| Example 19 | (1-1) | (1-5) | 6/4 | (2-1) | 10/10 |
| Example 20 | (1-1) | (1-5) | 8/2 | (2-1) | 10/10 |
| Example 21 | (1-1) | (1-5) | 5/5 | (2-1) | 10/10 |
| Example 22 | (1-1) | (1-5) | 7/3 | (2-1) | 10/10 |
| Example 23 | (1-1) | (1-5) | 3/7 | (2-1) | 10/10 |
| Example 24 | (1-1) | — | — | (2-1) | 10/10 |
| Example 25 | (1-1) | — | — | (2-1) | 10/10 |
| Example 26 | (1-2) | — | — | (2-1) | 10/10 |
| Example 27 | (1-2) | — | — | (2-1) | 10/10 |
| Example 28 | (1-3) | — | — | (2-1) | 10/10 |
| Example 29 | (1-3) | — | — | (2-1) | 10/10 |
| Example 30 | (1-4) | — | — | (2-1) | 10/10 |
| Example 31 | (1-4) | — | — | (2-1) | 10/10 |
| Example 32 | (1-5) | — | — | (2-1) | 10/10 |
| Example 33 | (1-5) | — | — | (2-1) | 10/10 |
| Example 34 | (1-1) | — | — | (2-1) | 8/10 |
| Example 35 | (1-1) | — | — | (2-1) | 7/10 |
| Example 36 | (1-1) | — | — | (2-1) | 9/10 |
| Example 37 | (1-1) | — | — | (2-1) | 12/10 |
| Example 38 | (1-1) | — | — | (2-1) | 6/10 |
| Example 39 | (1-1) | — | — | (2-1) | 11/10 |
| Example 40 | (1-1) | (1-5) | 6/4 | (2-2)/(2-3) = 5/5 | 10/10 |
| Example 41 | (1-1) | (1-5) | 6/4 | (2-2)/(2-3) = 5/5 | 10/10 |
| Example 42 | (1-1) | (1-5) | 8/2 | (2-2)/(2-3) = 5/5 | 10/10 |
| Example 43 | (1-1) | (1-5) | 9/1 | (2-2)/(2-3) = 5/5 | 10/10 |
| Example 44 | (1-5) | — | — | (2-2)/(2-3) = 5/5 | 10/10 |
| Example 45 | (1-1) | (1-5) | 6/4 | (3-1)/(3-2) = 5/5 | 10/10 |
| Example 46 | (1-1) | (1-5) | 6/4 | (3-1)/(3-2) = 5/5 | 10/10 |
| Example 47 | (1-1) | (1-5) | 8/2 | (3-1)/(3-2) = 5/5 | 10/10 |
| Example 48 | (1-1) | (1-5) | 9/1 | (3-1)/(3-2) = 5/5 | 10/10 |
| Example 49 | (1-5) | — | — | (3-1)/(3-2) = 5/5 | 10/10 |
| Example 50 | (1-1) | (1-5) | 6/4 | (3-6) | 10/10 |
| Example 51 | (1-1) | (1-5) | 6/4 | (3-6) | 10/10 |
| Example 52 | (1-1) | (1-5) | 8/2 | (3-6) | 10/10 |
| Example 53 | (1-1) | (1-5) | 9/1 | (3-6) | 10/10 |
| Example 54 | (1-5) | — | — | (3-6) | 10/10 |

TABLE 3-continued

| | Charge transporting substance | | CT1/CT2 | Binder | (CT1 + CT2)/B |
|---|---|---|---|---|---|
| | CT1 | CT2 | ratio | resin | ratio |
| Example 55 | (1-1) | (1-5) | 9/1 | (2-1) | 10/10 |
| Example 56 | (1-1) | (1-5) | 7/3 | (2-1) | 10/10 |
| Example 57 | (1-1) | (1-5) | 7/3 | (2-1) | 10/10 |
| Example 58 | (1-5) | — | — | (2-1) | 10/10 |
| Example 59 | (1-1) | (1-5) | 9/1 | (2-1) | 10/10 |
| Example 60 | (1-1) | (1-5) | 7/3 | (2-1) | 10/10 |
| Example 61 | (1-1) | (1-5) | 7/3 | (2-1) | 10/10 |
| Example 62 | (1-5) | — | — | (2-1) | 10/10 |
| Example 63 | (1-1) | (1-5) | 9/1 | (2-1) | 10/10 |
| Example 64 | (1-1) | (1-5) | 7/3 | (2-1) | 10/10 |
| Example 65 | (1-1) | (1-5) | 7/3 | (2-1) | 10/10 |
| Example 66 | (1-5) | — | — | (2-1) | 10/10 |
| Example 67 | (1-1) | (1-5) | 9/1 | (3-1)/(3-2) = 5/5 | 10/10 |
| Example 68 | (1-1) | (1-5) | 7/3 | (3-1)/(3-2) = 5/5 | 10/10 |
| Example 69 | (1-1) | (1-5) | 7/3 | (3-1)/(3-2) = 5/5 | 10/10 |
| Example 70 | (1-5) | — | — | (3-1)/(3-2) = 5/5 | 10/10 |
| Example 71 | (1-1) | (1-5) | 9/1 | (3-1)/(3-2) = 5/5 | 10/10 |
| Example 72 | (1-1) | (1-5) | 7/3 | (3-1)/(3-2) = 5/5 | 10/10 |
| Example 73 | (1-1) | (1-5) | 7/3 | (3-1)/(3-2) = 5/5 | 10/10 |
| Example 74 | (1-5) | — | — | (3-1)/(3-2) = 5/5 | 10/10 |
| Example 75 | (1-1) | (1-5) | 9/1 | (3-1)/(3-2) = 5/5 | 10/10 |
| Example 76 | (1-1) | (1-5) | 7/3 | (3-1)/(3-2) = 5/5 | 10/10 |
| Example 77 | (1-1) | (1-5) | 7/3 | (3-1)/(3-2) = 5/5 | 10/10 |
| Example 78 | (1-5) | — | — | (3-1)/(3-2) = 5/5 | 10/10 |
| Example 159 | (1-1) | (1-5) | 8/2 | (2-1) | 10/10 |
| Example 160 | (1-1) | (1-5) | 8/2 | (2-1) | 10/10 |
| Example 161 | (1-1) | (1-5) | 8/2 | (2-1) | 10/10 |
| Example 162 | (1-1) | (1-5) | 8/2 | (2-1) | 10/10 |
| Example 163 | (1-1) | (1-5) | 8/2 | (2-1) | 10/10 |
| Example 164 | (1-1) | (1-5) | 8/2 | (2-1) | 10/10 |
| Example 165 | (1-1) | (1-5) | 8/2 | (2-1) | 10/10 |
| Example 166 | (1-1) | (1-5) | 8/2 | (2-1) | 10/10 |
| Example 167 | (1-1) | (1-5) | 8/2 | (2-1) | 10/10 |
| Example 168 | (1-1) | (1-5) | 8/2 | (2-1) | 10/10 |
| Example 169 | (1-1) | (1-5) | 8/2 | (2-1) | 10/10 |
| Example 170 | (1-1) | (1-5) | 8/2 | (2-1) | 10/10 |
| Example 171 | (1-1) | (1-5) | 8/2 | (2-1) | 10/10 |
| Example 172 | (1-1) | (1-5) | 8/2 | (2-1) | 10/10 |
| Example 173 | (1-1) | (1-5) | 8/2 | (2-1) | 10/10 |
| Example 174 | (1-1) | (1-5) | 8/2 | (2-1) | 10/10 |
| Example 175 | (1-1) | (1-5) | 8/2 | (2-1) | 10/10 |
| Example 176 | (1-1) | (1-5) | 8/2 | (2-1) | 10/10 |
| Example 177 | (1-1) | (1-5) | 8/2 | (2-1) | 10/10 |
| Example 178 | (1-1) | (1-5) | 8/2 | (2-1) | 10/10 |
| Example 179 | (1-1) | (1-5) | 8/2 | (2-1) | 10/10 |
| Example 180 | (1-1) | (1-5) | 8/2 | (2-1) | 10/10 |
| Example 181 | (1-1) | (1-5) | 8/2 | (2-1) | 10/10 |
| Example 182 | (1-1) | (1-5) | 8/2 | (2-1) | 10/10 |
| Example 183 | (1-1) | (1-5) | 8/2 | (2-1) | 10/10 |
| Example 184 | (1-1) | (1-5) | 8/2 | (2-1) | 10/10 |
| Example 185 | (1-1) | (1-5) | 8/2 | (2-1) | 10/10 |
| Example 186 | (1-1) | (1-5) | 8/2 | (2-1) | 10/10 |
| Example 187 | (1-1) | (1-5) | 8/2 | (2-1) | 10/10 |
| Example 188 | (1-1) | (1-5) | 8/2 | (2-1) | 10/10 |
| Example 189 | (1-1) | (1-5) | 8/2 | (2-1) | 10/10 |
| Example 190 | (1-1) | (1-5) | 8/2 | (2-1) | 10/10 |
| Example 191 | (1-1) | (1-5) | 8/2 | (2-1) | 10/10 |
| Example 192 | (1-1) | (1-5) | 8/2 | (2-1) | 10/10 |
| Example 193 | (1-1) | (1-5) | 8/2 | (2-1) | 10/10 |
| Example 194 | (1-1) | (1-5) | 8/2 | (2-1) | 10/10 |
| Example 195 | (1-1) | (1-5) | 8/2 | (2-1) | 10/10 |
| Example 196 | (1-1) | (1-5) | 8/2 | (2-1) | 10/10 |
| Example 197 | (1-1) | (1-5) | 8/2 | (2-1) | 10/10 |
| Example 198 | (1-1) | (1-5) | 8/2 | (2-1) | 10/10 |
| Example 199 | (1-1) | (1-5) | 8/2 | (2-1) | 10/10 |
| Example 200 | (1-1) | (1-5) | 8/2 | (2-1) | 10/10 |
| Example 201 | (1-1) | (1-5) | 8/2 | (2-1) | 10/10 |
| Example 202 | (1-1) | (1-5) | 8/2 | (2-1) | 10/10 |
| Example 203 | (1-1) | (1-5) | 8/2 | (2-1) | 10/10 |
| Example 204 | (1-1) | (1-5) | 8/2 | (2-1) | 10/10 |
| Example 205 | (1-1) | (1-5) | 8/2 | (2-1) | 10/10 |
| Example 206 | (1-1) | (1-5) | 8/2 | (2-1) | 10/10 |
| Example 207 | (1-1) | (1-5) | 8/2 | (2-1) | 10/10 |
| Example 208 | (1-1) | (1-5) | 8/2 | (2-1) | 10/10 |

TABLE 3-continued

| | Charge transporting substance | | CT1/CT2 | Binder | (CT1 + CT2)/B |
|---|---|---|---|---|---|
| | CT1 | CT2 | ratio | resin | ratio |
| Example 209 | (1-1) | (1-5) | 8/2 | (2-1) | 10/10 |
| Example 210 | (1-1) | (1-5) | 8/2 | (2-1) | 10/10 |
| Example 211 | (1-1) | (1-5) | 8/2 | (2-1) | 10/10 |
| Example 212 | (1-1) | (1-5) | 8/2 | (2-1) | 10/10 |

TABLE 3-continued

| | Charge transporting substance | | CT1/CT2 | Binder | (CT1 + CT2)/B |
|---|---|---|---|---|---|
| | CT1 | CT2 | ratio | resin | ratio |
| Example 240 | (1-1) | (1-5) | 8/2 | (2-1) | 10/10 |
| Example 241 | (1-1) | (1-5) | 8/2 | (2-1) | 10/10 |
| Example 242 | (1-1) | (1-5) | 8/2 | (2-1) | 10/10 |

TABLE 4

| | Kinds and ratios of organic solvents | | | | | Evaluation for liquid stability | | | |
|---|---|---|---|---|---|---|---|---|---|
| | | | | | | Immediately after preparation | | After stirring after standing for 2 weeks | |
| | Hydrophobic organic solvent (first liquid) | Hydrophilic organic solvent (second liquid) | Ratio of hydrophobic organic solvent to hydrophilic organic solvent | Ratio of water to organic solvents | Addition amount of surfactant | Visual observation | Average particle diameter | Visual observation | Average particle diameter |
| Example 1 | Toluene | Dimethoxymethane | 2/1 | 6/4 | 0 mass % | Uniform and semitransparent | 2.5 μm | Uniform and semitransparent | 2.7 μm |
| Example 2 | Toluene | Tetrahydrofuran | 5/5 | 5/5 | 0 mass % | Uniform and semitransparent | 2.1 μm | Uniform and semitransparent | 2.3 μm |
| Example 3 | Chlorobenzene | Tetrahydrofuran | 6/4 | 7/3 | 0 mass % | Uniform and semitransparent | 2.4 μm | Uniform and semitransparent | 2.6 μm |
| Example 4 | o-Xylene | Dimethoxymethane | 6/4 | 6/4 | 0 mass % | Uniform and semitransparent | 2.6 μm | Uniform and semitransparent | 2.7 μm |
| Example 5 | o-Xylene | Tetrahydrofuran | 5/5 | 5/5 | 0 mass % | Uniform and semitransparent | 2.2 μm | Uniform and semitransparent | 2.3 μm |
| Example 6 | o-Xylene | 1,3,5-Trioxane | 7/3 | 6/4 | 0 mass % | Uniform and semitransparent | 3.3 μm | Uniform and semitransparent | 3.5 μm |
| Example 7 | Ethylbenzene | 1,4-Dioxane | 9/1 | 4/6 | 0 mass % | Uniform and bluish white | 5.5 μm | Uniform and bluish white | 6.2 μm |
| Example 8 | Chlorobenzene | Dimethoxymethane | 6/4 | 6/4 | 0 mass % | Uniform and semitransparent | 3.8 μm | Uniform and semitransparent | 4.1 μm |
| Example 9 | Chloroform | 1,2-Dioxane | 5/5 | 8/2 | 0 mass % | Uniform and semitransparent | 5.3 μm | Uniform and semitransparent | 5.5 μm |
| Example 10 | o-Dichlorobenzene | 1,3,5-Trioxane | 7/3 | 6/4 | 0 mass % | Uniform and semitransparent | 4.1 μm | Uniform and semitransparent | 4.2 μm |
| Example 11 | Toluene | 1,3,5-Trioxane | 6/4 | 7/3 | 0 mass % | Uniform and semitransparent | 3.8 μm | Uniform and semitransparent | 4.2 μm |
| Example 12 | Chlorobenzene | 2-Pentanone | 5/5 | 6/4 | 0 mass % | Uniform and bluish white | 7.8 μm | Uniform and bluish white | 8.3 μm |
| Example 13 | Toluene | 2-Pentanone | 2/8 | 6/4 | 0 mass % | Uniform and bluish white | 7.5 μm | Uniform and bluish white | 8.2 μm |
| Example 14 | o-Xylene | 1,3-Dioxane | 2/8 | 6/4 | 0 mass % | Uniform and bluish white | 6.2 μm | Uniform and bluish white | 6.5 μm |
| Example 15 | o-Xylene | Tetrahydrofuran | 7/3 | 6/4 | 0 mass % | Uniform and semitransparent | 3.0 μm | Uniform and semitransparent | 3.2 μm |
| Example 16 | o-Xylene | Tetrahydrofuran | 9/1 | 6/4 | 0 mass % | Uniform and semitransparent | 4.0 μm | Uniform and semitransparent | 4.2 μm |
| Example 17 | Chloroform | Methanol | 9/1 | 6/4 | 0 mass % | Uniform and semitransparent | 5.5 μm | Uniform and semitransparent | 5.7 μm |
| Example 18 | Chlorobenzene | 1,4-Dioxane | 6/4 | 7/3 | 0 mass % | Uniform and semitransparent | 4.2 μm | Uniform and semitransparent | 4.5 μm |
| Example 19 | Chlorobenzene | 1,3,5-Trioxane | 5/5 | 5/5 | 0 mass % | Uniform and semitransparent | 4.7 μm | Uniform and semitransparent | 4.8 μm |
| Example 20 | o-Dichlorobenzene | Tetrahydrofuran | 5/5 | 6/4 | 0 mass % | Uniform and semitransparent | 2.7 μm | Uniform and semitransparent | 3.0 μm |
| Example 21 | o-Dichlorobenzene | Dimethoxymethane | 6/4 | 7/3 | 0 mass % | Uniform and semitransparent | 4.6 μm | Uniform and semitransparent | 4.8 μm |
| Example 22 | Toluene | Dimethoxymethane | 7/3 | 6/4 | 0 mass % | Uniform and semitransparent | 3.8 μm | Uniform and semitransparent | 4.0 μm |
| Example 23 | Toluene | Tetrahydrofuran | 5/5 | 5/5 | 0 mass % | Uniform and semitransparent | 2.1 μm | Uniform and semitransparent | 2.3 μm |
| Example 24 | Chlorobenzene | Tetrahydrofuran | 6/4 | 7/3 | 0 mass % | Uniform and semitransparent | 2.6 μm | Uniform and semitransparent | 2.8 μm |
| Example 25 | o-Xylene | Dimethoxymethane | 6/4 | 6/4 | 0 mass % | Uniform and semitransparent | 2.9 μm | Uniform and semitransparent | 3.3 μm |

TABLE 4-continued

| | Kinds and ratios of organic solvents | | | | | Evaluation for liquid stability | | | |
|---|---|---|---|---|---|---|---|---|---|
| | | | | | | Immediately after preparation | | After stirring after standing for 2 weeks | |
| | Hydrophobic organic solvent (first liquid) | Hydrophilic organic solvent (second liquid) | Ratio of hydrophobic organic solvent to hydrophilic organic solvent | Ratio of water to organic solvents | Addition amount of surfactant | Visual observation | Average particle diameter | Visual observation | Average particle diameter |
| Example 26 | o-Xylene | Tetrahydrofuran | 5/5 | 5/5 | 0 mass % | Uniform and semitransparent | 2.2 μm | Uniform and semitransparent | 2.3 μm |
| Example 27 | o-Xylene | 1,3,5-Trioxane | 7/3 | 6/4 | 0 mass % | Uniform and semitransparent | 4.1 μm | Uniform and semitransparent | 4.3 μm |
| Example 28 | Ethylbenzene | 1,4-Dioxane | 9/1 | 4/6 | 0 mass % | Uniform and semitransparent | 3.3 μm | Uniform and semitransparent | 3.5 μm |
| Example 29 | Chlorobenzene | Dimethoxymethane | 6/4 | 6/4 | 0 mass % | Uniform and semitransparent | 4.4 μm | Uniform and semitransparent | 4.5 μm |
| Example 30 | Chloroform | 1,4-Dioxane | 5/5 | 8/2 | 0 mass % | Uniform and semitransparent | 4.3 μm | Uniform and semitransparent | 4.4 μm |
| Example 31 | o-Dichlorobenzene | 1,3,5-Trioxane | 7/3 | 6/4 | 0 mass % | Uniform and semitransparent | 4.5 μm | Uniform and semitransparent | 4.7 μm |
| Example 32 | Toluene | 1,3,5-Trioxane | 6/4 | 7/3 | 0 mass % | Uniform and semitransparent | 4.1 μm | Uniform and semitransparent | 4.4 μm |
| Example 33 | Toluene | 1,2-Dioxane | 5/5 | 6/4 | 0 mass % | Uniform and semitransparent | 3.1 μm | Uniform and semitransparent | 3.3 μm |
| Example 34 | Toluene | Tetrahydrofuran | 2/8 | 6/4 | 0 mass % | Uniform and semitransparent | 2.8 μm | Uniform and semitransparent | 3.1 μm |
| Example 35 | o-Xylene | 1,3-Dioxane | 2/8 | 6/4 | 0 mass % | Uniform and semitransparent | 3.2 μm | Uniform and semitransparent | 3.3 μm |
| Example 36 | o-Xylene | Tetrahydrofuran | 7/3 | 6/4 | 0 mass % | Uniform and semitransparent | 2.5 μm | Uniform and semitransparent | 2.7 μm |
| Example 37 | o-Xylene | Tetrahydrofuran | 9/1 | 6/4 | 0 mass % | Uniform and semitransparent | 1.8 μm | Uniform and semitransparent | 2.0 μm |
| Example 38 | Chloroform | Dimethoxymethane | 5/5 | 6/4 | 0 mass % | Uniform and semitransparent | 4.4 μm | Uniform and semitransparent | 4.6 μm |
| Example 39 | Chlorobenzene | 1,4-Dioxane | 6/4 | 7/3 | 0 mass % | Uniform and semitransparent | 2.6 μm | Uniform and semitransparent | 2.7 μm |
| Example 40 | Chlorobenzene | 1,3,5-Trioxane | 5/5 | 5/5 | 0 mass % | Uniform and semitransparent | 4.7 μm | Uniform and semitransparent | 4.8 μm |
| Example 41 | o-Dichlorobenzene | Tetrahydrofuran | 5/5 | 6/4 | 0 mass % | Uniform and semitransparent | 2.4 μm | Uniform and semitransparent | 2.7 μm |
| Example 42 | o-Dichlorobenzene | Dimethoxymethane | 6/4 | 7/3 | 0 mass % | Uniform and semitransparent | 3.5 μm | Uniform and semitransparent | 3.7 μm |
| Example 43 | Toluene | Dimethoxymethane | 7/3 | 7/3 | 0 mass % | Uniform and semitransparent | 3.4 μm | Uniform and semitransparent | 3.6 μm |
| Example 44 | Toluene | Tetrahydrofuran | 5/5 | 6/4 | 0 mass % | Uniform and semitransparent | 2.2 μm | Uniform and semitransparent | 2.4 μm |
| Example 45 | Chlorobenzene | 1,4-Dioxane | 6/4 | 7/3 | 0 mass % | Uniform and semitransparent | 2.8 μm | Uniform and semitransparent | 2.8 μm |
| Example 46 | o-Xylene | Tetrahydrofuran | 5/5 | 6/4 | 0 mass % | Uniform and semitransparent | 2.7 μm | Uniform and semitransparent | 2.9 μm |
| Example 47 | o-Xylene | Dimethoxymethane | 6/4 | 7/3 | 0 mass % | Uniform and semitransparent | 3.4 μm | Uniform and semitransparent | 3.6 μm |
| Example 48 | o-Dichlorobenzene | Tetrahydrofuran | 6/4 | 7/3 | 0 mass % | Uniform and semitransparent | 2.6 μm | Uniform and semitransparent | 2.7 μm |
| Example 49 | Chloroform | Tetrahydrofuran | 5/5 | 6/4 | 0 mass % | Uniform and semitransparent | 2.9 μm | Uniform and semitransparent | 3.2 μm |
| Example 50 | Ethylbenzene | Tetrahydrofuran | 5/5 | 6/4 | 0 mass % | Uniform and semitransparent | 3.8 μm | Uniform and semitransparent | 4.1 μm |
| Example 51 | Toluene | Dimethoxymethane | 7/3 | 7/3 | 0 mass % | Uniform and semitransparent | 3.3 μm | Uniform and semitransparent | 3.5 μm |
| Example 52 | Toluene | Tetrahydrofuran | 5/5 | 6/4 | 0 mass % | Uniform and semitransparent | 2.8 μm | Uniform and semitransparent | 3.2 μm |
| Example 53 | Chlorobenzene | 1,4-Dioxane | 6/4 | 7/3 | 0 mass % | Uniform and semitransparent | 3.9 μm | Uniform and semitransparent | 4.2 μm |
| Example 54 | o-Xylene | Tetrahydrofuran | 5/5 | 6/4 | 0 mass % | Uniform and semitransparent | 3.2 μm | Uniform and semitransparent | 3.4 μm |
| Example 55 | o-Xylene | Dimethoxymethane | 6/4 | 7/3 | 0.2 mass % | Uniform and semitransparent | 2.2 μm | Uniform and semitransparent | 2.4 μm |
| Example 56 | Toluene | Dimethoxymethane | 7/3 | 7/3 | 0.5 mass % | Uniform and semitransparent | 1.9 μm | Uniform and semitransparent | 2.3 μm |
| Example 57 | Toluene | Tetrahydrofuran | 5/5 | 6/4 | 1.0 mass % | Uniform and transparent | 0.8 μm | Uniform and semitransparent | 1.3 μm |
| Example 58 | o-Xylene | Tetrahydrofuran | 5/5 | 6/4 | 1.5 mass % | Uniform and transparent | 0.9 μm | Uniform and semitransparent | 1.3 μm |
| Example 59 | o-Xylene | Dimethoxymethane | 6/4 | 7/3 | 0.2 mass % | Uniform and semitransparent | 2.2 μm | Uniform and semitransparent | 2.3 μm |

TABLE 4-continued

| | Kinds and ratios of organic solvents | | | | | Evaluation for liquid stability | | | |
|---|---|---|---|---|---|---|---|---|---|
| | | | | | | Immediately after preparation | | After stirring after standing for 2 weeks | |
| | Hydrophobic organic solvent (first liquid) | Hydrophilic organic solvent (second liquid) | Ratio of hydrophobic organic solvent to hydrophilic organic solvent | Ratio of water to organic solvents | Addition amount of surfactant | Visual observation | Average particle diameter | Visual observation | Average particle diameter |
| Example 60 | Toluene | Dimethoxymethane | 7/3 | 7/3 | 0.5 mass % | Uniform and semitransparent | 1.9 μm | Uniform and semitransparent | 2.2 μm |
| Example 61 | Toluene | Tetrahydrofuran | 5/5 | 6/4 | 1.0 mass % | Uniform and transparent | 0.7 μm | Uniform and semitransparent | 1.1 μm |
| Example 62 | o-Xylene | Tetrahydrofuran | 5/5 | 6/4 | 1.5 mass % | Uniform and transparent | 0.7 μm | Uniform and semitransparent | 1.4 μm |
| Example 63 | o-Xylene | Dimethoxymethane | 6/4 | 7/3 | 0.2 mass % | Uniform and semitransparent | 2.3 μm | Uniform and semitransparent | 2.3 μm |
| Example 64 | Chlorobenzene | 1,4-Dioxane | 6/4 | 7/3 | 0.5 mass % | Uniform and semitransparent | 1.7 μm | Uniform and semitransparent | 2.0 μm |
| Example 65 | Chloroform | Tetrahydrofuran | 5/5 | 6/4 | 1.0 mass % | Uniform and transparent | 0.9 μm | Uniform and semitransparent | 1.5 μm |
| Example 66 | Toluene | Dimethoxymethane | 7/3 | 7/3 | 1.5 mass % | Uniform and semitransparent | 1.7 μm | Uniform and semitransparent | 1.8 μm |
| Example 67 | Toluene | Tetrahydrofuran | 5/5 | 6/4 | 0.2 mass % | Uniform and transparent | 0.8 μm | Uniform and semitransparent | 1.2 μm |
| Example 68 | o-Xylene | Tetrahydrofuran | 5/5 | 6/4 | 0.5 mass % | Uniform and transparent | 0.7 μm | Uniform and semitransparent | 1.4 μm |
| Example 69 | o-Xylene | Dimethoxymethane | 6/4 | 7/3 | 1.0 mass % | Uniform and semitransparent | 1.6 μm | Uniform and semitransparent | 1.8 μm |
| Example 70 | Chlorobenzene | 1,4-Dioxane | 6/4 | 7/3 | 1.5 mass % | Uniform and transparent | 0.9 μm | Uniform and semitransparent | 1.5 μm |
| Example 71 | Chloroform | Tetrahydrofuran | 5/5 | 6/4 | 0.2 mass % | Uniform and semitransparent | 1.5 μm | Uniform and semitransparent | 1.7 μm |
| Example 72 | Toluene | Dimethoxymethane | 7/3 | 7/3 | 0.5 mass % | Uniform and semitransparent | 1.4 μm | Uniform and semitransparent | 1.8 μm |
| Example 73 | Toluene | Tetrahydrofuran | 5/5 | 6/4 | 1.0 mass % | Uniform and transparent | 0.6 μm | Uniform and semitransparent | 1.0 μm |
| Example 74 | o-Xylene | Tetrahydrofuran | 5/5 | 6/4 | 1.5 mass % | Uniform and transparent | 0.6 μm | Uniform and transparent | 0.8 μm |
| Example 75 | o-Xylene | Dimethoxymethane | 6/4 | 7/3 | 0.2 mass % | Uniform and semitransparent | 1.9 μm | Uniform and semitransparent | 2.0 μm |
| Example 76 | Chlorobenzene | 1,4-Dioxane | 6/4 | 7/3 | 0.5 mass % | Uniform and semitransparent | 1.1 μm | Uniform and semitransparent | 1.3 μm |
| Example 77 | Toluene | Dimethoxymethane | 7/3 | 7/3 | 1.0 mass % | Uniform and semitransparent | 1.3 μm | Uniform and semitransparent | 1.5 μm |
| Example 78 | Toluene | Tetrahydrofuran | 5/5 | 6/4 | 1.5 mass % | Uniform and transparent | 0.6 μm | Uniform and transparent | 0.8 μm |
| Example 159 | p-Xylene | Ethanol | 7/3 | 5/5 | 0 mass % | Uniform and semitransparent | 3.8 μm | Uniform and semitransparent | 4.2 μm |
| Example 160 | Chlorobenzene | Tetrahydropyran | 5/5 | 6/4 | 0 mass % | Uniform and semitransparent | 2.4 μm | Uniform and semitransparent | 2.6 μm |
| Example 161 | Chloroform | Diethylene glycol dimethyl ether | 7/3 | 6/4 | 0 mass % | Uniform and semitransparent | 2.9 μm | Uniform and semitransparent | 3.1 μm |
| Example 162 | Toluene | Ethylene glycol dimethyl ether | 7/3 | 6/4 | 0 mass % | Uniform and semitransparent | 2.8 μm | Uniform and semitransparent | 3.0 μm |
| Example 163 | p-Xylene | Propylene glycol n-butyl ether | 7/3 | 6/4 | 0 mass % | Uniform and bluish white | 7.6 μm | Uniform and bluish white | 7.8 μm |
| Example 164 | o-Xylene | Propylene glycol monopropyl ether | 7/3 | 6/4 | 0 mass % | Uniform and semitransparent | 3.3 μm | Uniform and semitransparent | 3.4 μm |
| Example 165 | Toluene | Ethylene glycol monomethyl ether | 7/3 | 6/4 | 0 mass % | Uniform and semitransparent | 3.5 μm | Uniform and semitransparent | 3.7 μm |
| Example 166 | p-Xylene | Diethylene glycol monoethyl ether | 7/3 | 5/5 | 0 mass % | Uniform and semitransparent | 3.2 μm | Uniform and semitransparent | 3.4 μm |
| Example 167 | Chlorobenzene | Ethylene glycol monoisopropyl ether | 5/5 | 6/4 | 0 mass % | Uniform and semitransparent | 3.3 μm | Uniform and semitransparent | 3.5 μm |
| Example 168 | Chloroform | Ethylene glycol monobutyl ether | 7/3 | 6/4 | 0 mass % | Uniform and semitransparent | 3.5 μm | Uniform and semitransparent | 3.5 μm |
| Example 169 | Toluene | Ethylene glycol monoisobutyl ether | 7/3 | 6/4 | 0 mass % | Uniform and semitransparent | 3.5 μm | Uniform and semitransparent | 3.7 μm |

TABLE 4-continued

| | Kinds and ratios of organic solvents | | | | | Evaluation for liquid stability | | | |
|---|---|---|---|---|---|---|---|---|---|
| | | | | | | Immediately after preparation | | After stirring after standing for 2 weeks | |
| | Hydrophobic organic solvent (first liquid) | Hydrophilic organic solvent (second liquid) | Ratio of hydrophobic organic solvent to hydrophilic organic solvent | Ratio of water to organic solvents | Addition amount of surfactant | Visual observation | Average particle diameter | Visual observation | Average particle diameter |
| Example 170 | p-Xylene | Ethylene glycol monoallyl ether | 7/3 | 6/4 | 0 mass % | Uniform and semitransparent | 3.2 μm | Uniform and semitransparent | 3.6 μm |
| Example 171 | o-Xylene | Propylene glycol monomethyl ether | 7/3 | 6/4 | 0 mass % | Uniform and semitransparent | 3.2 μm | Uniform and semitransparent | 3.4 μm |
| Example 172 | Toluene | Dipropylene glycol monomethyl ether | 7/3 | 6/4 | 0 mass % | Uniform and semitransparent | 3.1 μm | Uniform and semitransparent | 3.4 μm |
| Example 173 | Toluene | Tripropylene glycol monomethyl ether | 7/3 | 5/5 | 0 mass % | Uniform and semitransparent | 3.5 μm | Uniform and semitransparent | 3.8 μm |
| Example 174 | p-Xylene | Propylene glycol monobutyl ether | 5/5 | 6/4 | 0 mass % | Uniform and bluish white | 7.0 μm | Uniform and bluish white | 7.5 μm |
| Example 175 | Chlorobenzene | Propylene glycol monomethyl ether acetate | 7/3 | 6/4 | 0 mass % | Uniform and semitransparent | 4.8 μm | Uniform and semitransparent | 5.2 μm |
| Example 176 | Chloroform | Diethylene glycol methyl ethyl ether | 7/3 | 6/4 | 0 mass % | Uniform and semitransparent | 3.4 μm | Uniform and semitransparent | 3.5 μm |
| Example 177 | Toluene | Diethylene glycol diethyl ether | 7/3 | 6/4 | 0 mass % | Uniform and semitransparent | 3.3 μm | Uniform and semitransparent | 3.6 μm |
| Example 178 | p-Xylene | Dipropylene glycol dimethyl ether | 7/3 | 6/4 | 0 mass % | Uniform and semitransparent | 4.8 μm | Uniform and semitransparent | 5.0 μm |
| Example 179 | o-Xylene | Propylene glycol diacetate | 7/3 | 6/4 | 0 mass % | Uniform and bluish white | 6.9 μm | Uniform and bluish white | 7.4 μm |
| Example 180 | Toluene | Methyl acetate | 7/3 | 5/5 | 0 mass % | Uniform and bluish white | 6.1 μm | Uniform and bluish white | 6.6 μm |
| Example 181 | p-Xylene | Ethyl acetate | 5/5 | 6/4 | 0 mass % | Uniform and bluish white | 6.6 μm | Uniform and bluish white | 7.3 μm |
| Example 182 | Chlorobenzene | n-Propyl alcohol | 7/3 | 6/4 | 0 mass % | Uniform and semitransparent | 3.7 μm | Uniform and semitransparent | 3.7 μm |
| Example 183 | Chloroform | 3-Methoxybutanol | 7/3 | 6/4 | 0 mass % | Uniform and semitransparent | 3.7 μm | Uniform and semitransparent | 3.9 μm |
| Example 184 | Toluene | 3-Methoxybutyl acetate | 7/3 | 6/4 | 0 mass % | Uniform and bluish white | 6.8 μm | Uniform and bluish white | 7.0 μm |
| Example 185 | o-Xylene | Ethylene glycol monomethyl ether acetate | 7/3 | 6/4 | 0 mass % | Uniform and semitransparent | 3.2 μm | Uniform and semitransparent | 3.2 μm |
| Example 186 | p-Xylene | Ethanol | 7/3 | 5/5 | 1.0 mass % | Uniform and semitransparent | 2.2 μm | Uniform and semitransparent | 2.6 μm |
| Example 187 | Chlorobenzene | Tetrahydropyran | 5/5 | 6/4 | 1.0 mass % | Uniform and semitransparent | 1.8 μm | Uniform and semitransparent | 2.0 μm |
| Example 188 | Chloroform | Diethylene glycol dimethyl ether | 7/3 | 6/4 | 1.0 mass % | Uniform and semitransparent | 2.4 μm | Uniform and semitransparent | 2.5 μm |
| Example 189 | Toluene | Ethylene glycol dimethyl ether | 7/3 | 6/4 | 1.0 mass % | Uniform and semitransparent | 2.4 μm | Uniform and semitransparent | 2.6 μm |
| Example 190 | p-Xylene | Propylene glycol n-butyl ether | 7/3 | 6/4 | 1.0 mass % | Uniform and semitransparent | 5.8 μm | Uniform and bluish white | 6.1 μm |
| Example 191 | o-Xylene | Propylene glycol monopropyl ether | 7/3 | 6/4 | 1.0 mass % | Uniform and semitransparent | 2.5 μm | Uniform and semitransparent | 2.6 μm |
| Example 192 | Toluene | Ethylene glycol monomethyl ether | 7/3 | 6/4 | 1.0 mass % | Uniform and semitransparent | 2.5 μm | Uniform and semitransparent | 2.8 μm |
| Example 193 | p-Xylene | Diethylene glycol monoethyl ether | 7/3 | 5/5 | 1.0 mass % | Uniform and semitransparent | 2.2 μm | Uniform and semitransparent | 2.4 μm |

TABLE 4-continued

| | Kinds and ratios of organic solvents | | | | | Evaluation for liquid stability | | | |
|---|---|---|---|---|---|---|---|---|---|
| | | | | | | Immediately after preparation | | After stirring after standing for 2 weeks | |
| | Hydrophobic organic solvent (first liquid) | Hydrophilic organic solvent (second liquid) | Ratio of hydrophobic organic solvent to hydrophilic organic solvent | Ratio of water to organic solvents | Addition amount of surfactant | Visual observation | Average particle diameter | Visual observation | Average particle diameter |
| Example 194 | Chlorobenzene | Ethylene glycol monoisopropyl ether | 5/5 | 6/4 | 1.0 mass % | Uniform and semitransparent | 2.5 μm | Uniform and semitransparent | 2.6 μm |
| Example 195 | Chloroform | Ethylene glycol monobutyl ether | 7/3 | 6/4 | 1.0 mass % | Uniform and semitransparent | 2.2 μm | Uniform and semitransparent | 2.3 μm |
| Example 196 | Toluene | Ethylene glycol monoisobutyl ether | 7/3 | 6/4 | 1.0 mass % | Uniform and semitransparent | 2.2 μm | Uniform and semitransparent | 2.5 μm |
| Example 197 | p-Xylene | Ethylene glycol monoallyl ether | 7/3 | 6/4 | 1.0 mass % | Uniform and semitransparent | 2.0 μm | Uniform and semitransparent | 2.3 μm |
| Example 198 | o-Xylene | Propylene glycol monomethyl ether | 7/3 | 6/4 | 1.0 mass % | Uniform and semitransparent | 2.4 μm | Uniform and semitransparent | 2.5 μm |
| Example 199 | Toluene | Dipropylene glycol monomethyl ether | 7/3 | 6/4 | 1.0 mass % | Uniform and semitransparent | 2.5 μm | Uniform and semitransparent | 2.6 μm |
| Example 200 | Toluene | Tripropylene glycol monomethyl ether | 7/3 | 5/5 | 1.0 mass % | Uniform and semitransparent | 2.5 μm | Uniform and semitransparent | 2.8 μm |
| Example 201 | p-Xylene | Propylene glycol monobutyl ether | 5/5 | 6/4 | 1.0 mass % | Uniform and semitransparent | 4.9 μm | Uniform and bluish white | 6.0 μm |
| Example 202 | Chlorobenzene | Propylene glycol monomethyl ether acetate | 7/3 | 6/4 | 1.0 mass % | Uniform and semitransparent | 3.3 μm | Uniform and semitransparent | 3.5 μm |
| Example 203 | Chloroform | Diethylene glycol methyl ethyl ether | 7/3 | 6/4 | 1.0 mass % | Uniform and semitransparent | 2.2 μm | Uniform and semitransparent | 2.3 μm |
| Example 204 | Toluene | Diethylene glycol diethyl ether | 7/3 | 6/4 | 1.0 mass % | Uniform and semitransparent | 2.1 μm | Uniform and semitransparent | 2.5 μm |
| Example 205 | p-Xylene | Dipropylene glycol dimethyl ether | 7/3 | 6/4 | 1.0 mass % | Uniform and semitransparent | 3.8 μm | Uniform and semitransparent | 4.4 μm |
| Example 206 | o-Xylene | Propylene glycol diacetate | 7/3 | 6/4 | 1.0 mass % | Uniform and semitransparent | 5.7 μm | Uniform and bluish white | 6.4 μm |
| Example 207 | Toluene | Methyl acetate | 7/3 | 5/5 | 1.0 mass % | Uniform and semitransparent | 4.8 μm | Uniform and semitransparent | 5.4 μm |
| Example 208 | p-Xylene | Ethyl acetate | 5/5 | 6/4 | 1.0 mass % | Uniform and semitransparent | 5.7 μm | Uniform and bluish white | 6.0 μm |
| Example 209 | Chlorobenzene | n-Propyl alcohol | 7/3 | 6/4 | 1.0 mass % | Uniform and semitransparent | 2.4 μm | Uniform and semitransparent | 2.6 μm |
| Example 210 | Chloroform | 3-Methoxybutanol | 7/3 | 6/4 | 1.0 mass % | Uniform and semitransparent | 2.5 μm | Uniform and semitransparent | 2.8 μm |
| Example 211 | Toluene | 3-Methoxybutyl acetate | 7/3 | 6/4 | 1.0 mass % | Uniform and semitransparent | 5.5 μm | Uniform and bluish white | 6.1 μm |
| Example 212 | o-Xylene | Ethylene glycol monomethyl ether acetate | 7/3 | 6/4 | 1.0 mass % | Uniform and semitransparent | 1.9 μm | Uniform and semitransparent | 2.2 μm |
| Example 240 | Phenetole | Tetrahydrofuran | 7/3 | 6/4 | 1.0 mass % | Uniform and semitransparent | 1.2 μm | Uniform and semitransparent | 1.4 μm |
| Example 241 | Phenetole | Dimethoxymethane | 7/3 | 6/4 | 1.0 mass % | Uniform and semitransparent | 1.8 μm | Uniform and semitransparent | 2.0 μm |
| Example 242 | Phenetole | 1,4-Dioxane | 6/4 | 7/3 | 1.0 mass % | Uniform and semitransparent | 1.2 μm | Uniform and semitransparent | 1.4 μm |

TABLE 5

| | Charge transporting substance | | CT1/CT2 | Binder | (CT1 + CT2)/B |
|---|---|---|---|---|---|
| | CT1 | CT2 | ratio | resin | ratio |
| Comparative Example 1 | (1-5) | — | — | (2-1) | 10/10 |
| Comparative Example 2 | (1-3) | — | — | (2-1) | 10/10 |
| Comparative Example 3 | (1-5) | — | — | (2-1) | 10/10 |
| Comparative Example 4 | (1-3) | — | — | (2-1) | 10/10 |
| Comparative Example 5 | (1-5) | — | — | (2-1) | 10/10 |
| Comparative Example 6 | (1-5) | (1-3) | 8/2 | (2-1) | 10/10 |
| Comparative Example 7 | (1-5) | — | — | (2-1) | 10/10 |
| Comparative Example 8 | (1-5) | — | — | (2-1) | 10/10 |
| Comparative Example 9 | (1-5) | — | — | (2-1) | 10/10 |
| Comparative Example 10 | (1-5) | — | — | (2-1) | 10/10 |

the present invention including dissolving the charge transporting substance and the binder resin with a liquid containing both the first liquid that is hydrophobic and the second liquid that is hydrophilic, and mixing the solution with water to produce an emulsion for a charge transporting layer, an emulsified state is stably maintained even in a long-term storage state and hence an emulsion similar to that at an initial stage is obtained. In the conventional emulsion for a charge transporting layer formed of a hydrophobic organic solvent and water described in Patent Literature 1, an oil droplet containing the charge transporting substance and the binder resin is relatively stable immediately after the production of the emulsion as a result of the addition of the surfactant. After long-term storage, however, oil droplets coalesce to cause agglomeration. In order that an emulsion for a charge transporting layer may be produced, the charge transporting substance and the binder resin need to be dissolved once in an organic solvent (a halogen-based solvent or an aromatic solvent) in which the substance and the resin are highly soluble. The content of an organic solvent having a low affinity for water is preferably reduced in order that the coalescence of oil droplets in emulsified states may be suppressed. However, when an attempt is made to reduce the content of the organic solvent, the concentration of each

TABLE 6

| | Kinds and ratios of organic solvents | | | | | | Evaluation for liquid stability | | | |
|---|---|---|---|---|---|---|---|---|---|---|
| | | | | | | | Immediately after preparation | | After stirring after standing for 2 weeks | |
| | Hydrophobic organic solvent (first liquid) | Any other organic solvent | Hydrophilic organic solvent (second liquid) | Ratio of hydrophobic organic solvent to hydrophilic organic solvent | Ratio of water to organic solvents | Addition amount of surfactant | Visual observation | Average particle diameter | Visual observation | Average particle diameter |
| Comparative Example 1 | Toluene | — | — | — | 5/5 | 1.5 wt % | Sedimentation and coalescence occurred | 18.6 μm | Agglomeration occurred | 80.8 μm |
| Comparative Example 2 | o-Xylene | — | — | — | 5/5 | 1.5 wt % | Sedimentation and coalescence occurred | 17.1 μm | Agglomeration occurred | 93.1 μm |
| Comparative Example 3 | Toluene | — | — | — | 6/4 | 1.5 wt % | Sedimentation and coalescence occurred | 15.6 μm | Agglomeration occurred | 73.7 μm |
| Comparative Example 4 | o-Xylene | — | — | — | 6/4 | 1.5 wt % | Sedimentation and coalescence occurred | 16.8 μm | Agglomeration occurred | 77.2 μm |
| Comparative Example 5 | Toluene | — | — | — | 7/3 | 1.5 wt % | Agglomeration occurred | 130.5 μm | Emulsification did not occur | — |
| Comparative Example 6 | o-Xylene | — | — | — | 7/3 | 1.5 wt % | Agglomeration occurred | 115 μm | Emulsification did not occur | — |
| Comparative Example 7 | Ethylbenzene | — | — | — | 6/4 | 0 wt % | Emulsification did not occur | — | Emulsification did not occur | — |
| Comparative Example 8 | Toluene | Dipropylene glycol monobutyl ether | — | — | 6/4 | 1.5 wt % | Sedimentation and coalescence occurred | 16.8 μm | Agglomeration occurred | 60.2 μm |
| Comparative Example 9 | Toluene | Diethylene glycol monophenyl ether | — | — | 6/4 | 1.5 wt % | Sedimentation and coalescence occurred | 14.1 μm | Agglomeration occurred | 48.8 μm |
| Comparative Example 10 | Toluene | 1,4-Butanediol diacetate | — | — | 6/4 | 1.5 wt % | Sedimentation and coalescence occurred | 12.6 μm | Agglomeration occurred | 28.5 μm |

As can be seen from comparison between the examples and the comparative examples, in the production method of of the charge transporting substance and the binder resin in the organic solution is so high that a state where the emulsion is hard to form is established. A method involving increasing the content of the surfactant is also conceivable for suppressing the coalescence. However, the method is not preferred because the surfactant is generally liable to cause the deterioration of the characteristics of an electrophotographic photosensitive member.

In the production method of the present invention including dissolving the charge transporting substance and the binder resin with the hydrophobic organic solvent and the hydrophilic organic solvent, and mixing the solution with water to produce an emulsion for a charge transporting layer, at the time of the production of the emulsion, the second liquid as a hydrophilic liquid in an oil droplet quickly migrates toward an aqueous phase side and hence the oil droplet becomes additionally small, and the concentration of each of the charge transporting substance and the binder resin in the oil droplet increases. As a result, an emulsified particle adopts a form close to a fine particle of a solid and hence the occurrence of the agglomeration of oil droplets can be significantly suppressed as compared with that in the case where an emulsion is produced with the first liquid as a hydrophobic solvent alone. According to the method, the content of the organic solvent (a halogen-based solvent or an aromatic solvent) in which the charge transporting substance and the binder resin in the emulsion for a charge transporting layer are highly soluble can be reduced, and the long-term liquid stability of the emulsion is good. Accordingly, the emulsion is useful as an application liquid for an electrophotographic photosensitive member.

Example 79

An aluminum cylinder having a diameter of 30 mm and a length of 260.5 mm was used as a support. Next, 10 parts of $SnO_2$-coated barium sulfate (conductive particle), 2 parts of titanium oxide (pigment for controlling resistance), 6 parts of a phenol resin, and 0.001 part of silicone oil (leveling agent) were used together with a mixed solvent of 4 parts of methanol and 16 parts of methoxypropanol, to thereby prepare an application liquid for the conductive layer. The application liquid for the conductive layer was applied onto the aluminum cylinder by dip coating and hardened (thermally hardened) at 140° C. for 30 minutes, to thereby form an conductive layer having a thickness of 15 μm.

Next, 3 parts of N-methoxymethylated nylon and 3 parts of copolymer nylon were dissolved in a mixed solvent of 65 parts of methanol and 30 parts of n-butanol, to thereby prepare an application liquid for the intermediate layer. The application liquid for an intermediate layer was applied onto the conductive layer by dip coating and dried at 100° C. for 10 minutes, to thereby form an intermediate layer having a thickness of 0.7 μm.

Next, 10 parts of hydroxygallium phthalocyanine (charge generating substance) having a crystal structure showing intense peaks at Bragg angles)(2θ±0.2° of 7.5°, 9.9°, 16.3°, 18.6°, 25.1°, and 28.3° in CuKα characteristic X-ray diffraction were prepared. To the hydroxygallium phthalocyanine were added 250 parts of cyclohexanone and 5 parts of a polyvinyl butyral (product name: S-LEC BX-1, manufactured by Sekisui Chemical Co., Ltd.), and the resultant mixture was dispersed by a sand mill apparatus using glass beads each having a diameter of 1 mm under a 23±3° C. atmosphere for 1 hour. After the dispersion, 250 parts of ethyl acetate were added to prepare an application liquid for the charge generating layer. The application liquid for the charge generating layer was applied onto the intermediate layer by dip coating and dried at 100° C. for 10 minutes, to thereby form a charge generating layer having a thickness of 0.26 μm.

Next, the emulsion produced in Example 1 as an application liquid for a charge transporting layer was applied onto the charge generating layer by dip coating and heated at 130° C. for 1 hour to form a charge transporting layer having a thickness of 10 μm. Thus, an electrophotographic photosensitive member was produced. Table 7 shows the emulsion used and conditions for the heating of a coat obtained by applying the emulsion.

It should be noted that the emulsion was left to stand still for 2 weeks (under a temperature of 23° C. and a humidity of 50%) and then stirred with a homogenizer at 1,000 revolutions/min for 3 minutes before the emulsion was used in the dip coating.

Next, evaluations are described.

<Evaluation of Coat Surface for Uniformity>

The surface of a position distant from an end portion of a photosensitive member by 130 mm was subjected to measurement with a surface roughness measuring instrument (SURFCORDER SE-3400 manufactured by Kosaka Laboratory Ltd.) and an evaluation in conformance with a ten-point average roughness (Rzjis) evaluation in JIS B 0601: 2001 (evaluation length: 10 mm) was performed. Table 7 shows the results.

<Image Evaluation>

Before its use, a laser beam printer LBP-2510 manufactured by Canon Inc. was reconstructed so that, with regard to the charged potential (dark portion potential) of an electrophotographic photosensitive member and the exposure value (image exposure value) of a laser light source having a wavelength of 780 nm, a light quantity on the surface of the electrophotographic photosensitive member was 0.3 $\mu J/cm^2$. In addition, the evaluation was performed under an environment having a temperature of 23° C. and a relative humidity of 15%.

In the image evaluation, a monochromatic halftone image was output by using A4 size plain paper and the output image was evaluated by visual observation based on the following criteria. Table 7 shows the results.

Rank A: An entirely uniform image is observed.

Rank B: Extremely slight image unevenness is observed.

Rank C: Image unevenness is observed.

Rank D: Conspicuous image unevenness is observed.

Examples 80 to 156, 213 to 239, and 243 to 245

Electrophotographic photosensitive members were each produced by the same method as that of Example 79 except that: an emulsion shown in Table 7 was used for a charge transporting layer; and conditions for the heating of a coat obtained by applying the emulsion were changed as shown in Table 7. The evaluations of the photosensitive members were also performed by the same methods as those of Example 79. Table 7 shows the results.

Example 157

An organic electroluminescence device was produced as described below.

ITO was formed into a film having a thickness of 100 nm on a glass substrate as a support by a sputtering method. The resultant was subjected to ultrasonic washing with acetone and isopropyl alcohol (IPA) sequentially. After that, the resultant was subjected to boil washing with IPA and then dried. Further, the surface of the substrate was subjected to UV/ozone washing. Thus, an anode layer was obtained.

2 Parts of the compound (1-5) as a charge transporting substance were dissolved in 9 parts of toluene and 9 parts of tetrahydrofuran to prepare 20 parts of a solution. Next, 0.4 part of a NAROACTY CL-85 (manufactured by Sanyo Chemical Industries, Ltd., HLB=12.6) was added to 79.6 parts of ion-exchanged water (having a conductivity of 0.2 μS/cm) and then the contents were mixed. While the mixture was stirred with a homogenizer PHYSCOTRON manufactured by MICROTEC CO., LTD. at 3,000 revolutions/min, 20 parts of the prepared solution for a charge transporting layer were gradually added to the mixture for 10 minutes. After the completion of the addition, the number of revolutions of the homogenizer was increased to 5,000 revolutions/min and then the mixture was stirred for 10 minutes. After that, the mixture was subjected to dispersion with a high-pressure impact type disperser Nanomizer (manufactured by YOSHIDA KIKAI CO., LTD.) under a pressure condition of 150 MPa. Thus, an emulsion for a charge transporting layer (100 parts) was obtained.

The emulsion for a charge transporting layer was applied onto the anode layer by spin coating at 3,000 revolutions/min for 30 seconds so that a film having a thickness of 50 nm was obtained. Thus, a charge transporting layer was formed.

Next, tris(8-quinolinolato)aluminum ($Alq_3$) was deposited from the vapor to form a light emitting layer having a thickness of 25 nm.

Next, an electron injecting layer having a thickness of 15 nm was formed by co-depositing bathophenanthroline and cesium carbonate from the vapor so that the concentration of cesium in the layer was 8.3 mass %. After that, silver (Ag) was formed into a film on the layer by a heating deposition method. Thus, a cathode layer having a thickness of 12 nm was formed.

A voltage of 6 V was applied between the anode layer and the cathode layer. As a result, it was confirmed that the device emitted light at 8,000 Cd/cm$^2$.

Example 158

An organic electroluminescence device was produced by the same method as that of Example 157 except that N,N-di(naphthalene-1-yl)-N,N-diphenylbenzidine (NPB) as a charge transporting substance was used instead of the compound (1-5) in Example 157.

A voltage of 6 V was applied between the anode layer and the cathode layer. As a result, it was confirmed that the device emitted light at 9,000 Cd/cm$^2$.

Comparative Examples 11 to 18

Electrophotographic photosensitive members were each produced by the same method as that of Example 79 except that: an emulsion shown in Table 8 was used for a charge transporting layer; and conditions for the heating of a coat obtained by applying the emulsion were changed as shown in Table 8. The evaluations of the photosensitive members were also performed by the same methods as those of Example 79. Table 8 shows the results. Gentle irregularities were formed in each of the resultant electrophotographic photosensitive members and image unevenness corresponding to the irregularities was detected as an image.

Comparative Examples 19 and 20

Electrophotographic photosensitive members were each produced by the same method as that of Example 79 except that: a produced emulsion for a charge transporting layer was immediately used in dip coating without being left to stand still for 2 weeks; an emulsion shown in Table 8 was used; and conditions for the heating of a coat obtained by applying the emulsion were changed as shown in Table 8. The evaluations of the photosensitive members were also performed by the same methods as those of Example 79. Table 8 shows the results. Gentle irregularities were formed in each of the resultant electrophotographic photosensitive members and image unevenness corresponding to the irregularities was detected as an image.

Comparative Examples 21 to 23

Electrophotographic photosensitive members were each produced by the same method as that of Example 79 except that: an emulsion shown in Table 8 was used for a charge transporting layer; and conditions for the heating of a coat obtained by applying the emulsion were changed as shown in Table 8. The evaluations of the photosensitive members were also performed by the same methods as those of Example 79. Table 8 shows the results. Gentle irregularities were formed in each of the resultant electrophotographic photosensitive members and image unevenness corresponding to the irregularities was detected as an image.

TABLE 7

| | | Heating condition | | Evaluation | |
|---|---|---|---|---|---|
| | Emulsion | Heating temperature | Heating time | for thickness uniformity | Image evaluation |
| Example 79 | Example 1 | 130° C. | 60 minutes | 0.55 μm | A |
| Example 80 | Example 2 | 130° C. | 60 minutes | 0.52 μm | A |
| Example 81 | Example 3 | 130° C. | 60 minutes | 0.53 μm | A |
| Example 82 | Example 4 | 130° C. | 60 minutes | 0.55 μm | A |
| Example 83 | Example 5 | 130° C. | 60 minutes | 0.51 μm | A |
| Example 84 | Example 6 | 130° C. | 60 minutes | 0.58 μm | A |
| Example 85 | Example 7 | 130° C. | 60 minutes | 0.63 μm | B |
| Example 86 | Example 8 | 130° C. | 60 minutes | 0.57 μm | A |
| Example 87 | Example 9 | 130° C. | 60 minutes | 0.63 μm | B |
| Example 88 | Example 10 | 130° C. | 60 minutes | 0.57 μm | A |
| Example 89 | Example 11 | 130° C. | 60 minutes | 0.58 μm | A |
| Example 90 | Example 12 | 130° C. | 60 minutes | 0.68 μm | B |
| Example 91 | Example 13 | 130° C. | 60 minutes | 0.67 μm | B |
| Example 92 | Example 14 | 130° C. | 60 minutes | 0.63 μm | B |
| Example 93 | Example 15 | 150° C. | 60 minutes | 0.46 μm | A |
| Example 94 | Example 16 | 150° C. | 60 minutes | 0.47 μm | A |
| Example 95 | Example 17 | 130° C. | 60 minutes | 0.65 μm | B |
| Example 96 | Example 18 | 130° C. | 60 minutes | 0.55 μm | A |
| Example 97 | Example 19 | 130° C. | 60 minutes | 0.57 μm | A |
| Example 98 | Example 20 | 150° C. | 60 minutes | 0.45 μm | A |
| Example 99 | Example 21 | 130° C. | 60 minutes | 0.55 μm | A |
| Example 100 | Example 22 | 130° C. | 60 minutes | 0.54 μm | A |
| Example 101 | Example 23 | 130° C. | 60 minutes | 0.50 μm | A |
| Example 102 | Example 24 | 130° C. | 60 minutes | 0.50 μm | A |
| Example 103 | Example 25 | 130° C. | 60 minutes | 0.55 μm | A |
| Example 104 | Example 26 | 130° C. | 60 minutes | 0.53 μm | A |
| Example 105 | Example 27 | 130° C. | 60 minutes | 0.57 μm | A |
| Example 106 | Example 28 | 130° C. | 60 minutes | 0.57 μm | A |
| Example 107 | Example 29 | 130° C. | 60 minutes | 0.59 μm | A |
| Example 108 | Example 30 | 130° C. | 60 minutes | 0.60 μm | B |
| Example 109 | Example 31 | 130° C. | 60 minutes | 0.59 μm | A |
| Example 110 | Example 32 | 130° C. | 60 minutes | 0.58 μm | A |
| Example 111 | Example 33 | 130° C. | 60 minutes | 0.53 μm | A |
| Example 112 | Example 34 | 130° C. | 60 minutes | 0.51 μm | A |
| Example 113 | Example 35 | 130° C. | 60 minutes | 0.55 μm | A |
| Example 114 | Example 36 | 130° C. | 60 minutes | 0.50 μm | A |
| Example 115 | Example 37 | 150° C. | 40 minutes | 0.45 μm | A |
| Example 116 | Example 38 | 130° C. | 90 minutes | 0.57 μm | A |
| Example 117 | Example 39 | 130° C. | 60 minutes | 0.52 μm | A |
| Example 118 | Example 40 | 130° C. | 60 minutes | 0.58 μm | A |
| Example 119 | Example 41 | 130° C. | 60 minutes | 0.52 μm | A |

TABLE 7-continued

| | Emulsion | Heating condition: Heating temperature | Heating condition: Heating time | Evaluation for thickness uniformity | Image evaluation |
|---|---|---|---|---|---|
| Example 120 | Example 42 | 130° C. | 60 minutes | 0.56 μm | A |
| Example 121 | Example 43 | 130° C. | 60 minutes | 0.56 μm | A |
| Example 122 | Example 44 | 130° C. | 40 minutes | 0.51 μm | A |
| Example 123 | Example 45 | 130° C. | 60 minutes | 0.57 μm | A |
| Example 124 | Example 46 | 130° C. | 60 minutes | 0.53 μm | A |
| Example 125 | Example 47 | 130° C. | 60 minutes | 0.56 μm | A |
| Example 126 | Example 48 | 130° C. | 60 minutes | 0.52 μm | A |
| Example 127 | Example 49 | 130° C. | 60 minutes | 0.55 μm | A |
| Example 128 | Example 50 | 130° C. | 60 minutes | 0.57 μm | A |
| Example 129 | Example 51 | 130° C. | 60 minutes | 0.55 μm | A |
| Example 130 | Example 52 | 130° C. | 60 minutes | 0.52 μm | A |
| Example 131 | Example 53 | 130° C. | 60 minutes | 0.60 μm | B |
| Example 132 | Example 54 | 130° C. | 60 minutes | 0.57 μm | A |
| Example 133 | Example 55 | 130° C. | 60 minutes | 0.51 μm | A |
| Example 134 | Example 56 | 130° C. | 60 minutes | 0.49 μm | A |
| Example 135 | Example 57 | 130° C. | 60 minutes | 0.44 μm | A |
| Example 136 | Example 58 | 150° C. | 60 minutes | 0.49 μm | A |
| Example 137 | Example 59 | 130° C. | 60 minutes | 0.50 μm | A |
| Example 138 | Example 60 | 130° C. | 60 minutes | 0.49 μm | A |
| Example 139 | Example 61 | 150° C. | 60 minutes | 0.40 μm | A |
| Example 140 | Example 62 | 130° C. | 60 minutes | 0.45 μm | A |
| Example 141 | Example 63 | 130° C. | 60 minutes | 0.51 μm | A |
| Example 142 | Example 64 | 130° C. | 60 minutes | 0.49 μm | A |
| Example 143 | Example 65 | 150° C. | 60 minutes | 0.40 μm | A |
| Example 144 | Example 66 | 130° C. | 60 minutes | 0.47 μm | A |
| Example 145 | Example 67 | 130° C. | 60 minutes | 0.50 μm | A |
| Example 146 | Example 68 | 130° C. | 60 minutes | 0.48 μm | A |
| Example 147 | Example 69 | 130° C. | 60 minutes | 0.48 μm | A |
| Example 148 | Example 70 | 130° C. | 60 minutes | 0.44 μm | A |
| Example 149 | Example 71 | 130° C. | 60 minutes | 0.51 μm | A |
| Example 150 | Example 72 | 130° C. | 60 minutes | 0.50 μm | A |
| Example 151 | Example 73 | 130° C. | 60 minutes | 0.45 μm | A |
| Example 152 | Example 74 | 130° C. | 60 minutes | 0.44 μm | A |
| Example 153 | Example 75 | 130° C. | 60 minutes | 0.52 μm | A |
| Example 154 | Example 76 | 130° C. | 60 minutes | 0.49 μm | A |
| Example 155 | Example 77 | 130° C. | 60 minutes | 0.48 μm | A |
| Example 156 | Example 78 | 130° C. | 60 minutes | 0.46 μm | A |
| Example 213 | Example 159 | 130° C. | 60 minutes | 0.67 μm | B |
| Example 214 | Example 160 | 130° C. | 60 minutes | 0.56 μm | A |
| Example 215 | Example 161 | 130° C. | 60 minutes | 0.61 μm | B |
| Example 216 | Example 162 | 130° C. | 60 minutes | 0.62 μm | B |
| Example 217 | Example 163 | 130° C. | 60 minutes | 0.68 μm | B |
| Example 218 | Example 164 | 130° C. | 60 minutes | 0.66 μm | B |
| Example 219 | Example 165 | 130° C. | 60 minutes | 0.65 μm | B |
| Example 220 | Example 166 | 130° C. | 60 minutes | 0.61 μm | B |
| Example 221 | Example 167 | 130° C. | 60 minutes | 0.61 μm | B |
| Example 222 | Example 168 | 130° C. | 60 minutes | 0.64 μm | B |
| Example 223 | Example 169 | 130° C. | 60 minutes | 0.62 μm | B |
| Example 224 | Example 170 | 130° C. | 60 minutes | 0.61 μm | B |
| Example 225 | Example 171 | 130° C. | 60 minutes | 0.62 μm | B |
| Example 226 | Example 172 | 130° C. | 60 minutes | 0.62 μm | B |
| Example 227 | Example 173 | 130° C. | 60 minutes | 0.61 μm | B |
| Example 228 | Example 174 | 130° C. | 60 minutes | 0.68 μm | B |
| Example 229 | Example 175 | 130° C. | 60 minutes | 0.63 μm | B |
| Example 230 | Example 176 | 130° C. | 60 minutes | 0.54 μm | A |
| Example 231 | Example 177 | 130° C. | 60 minutes | 0.57 μm | A |
| Example 232 | Example 178 | 130° C. | 60 minutes | 0.64 μm | B |
| Example 233 | Example 179 | 130° C. | 60 minutes | 0.68 μm | B |
| Example 234 | Example 180 | 130° C. | 60 minutes | 0.66 μm | B |
| Example 235 | Example 181 | 130° C. | 60 minutes | 0.68 μm | B |
| Example 236 | Example 182 | 130° C. | 60 minutes | 0.62 μm | B |
| Example 237 | Example 183 | 130° C. | 60 minutes | 0.61 μm | B |
| Example 238 | Example 184 | 130° C. | 60 minutes | 0.67 μm | B |
| Example 239 | Example 185 | 130° C. | 60 minutes | 0.55 μm | A |
| Example 243 | Example 240 | 130° C. | 60 minutes | 0.54 μm | A |
| Example 244 | Example 241 | 130° C. | 60 minutes | 0.62 μm | B |
| Example 245 | Example 242 | 130° C. | 60 minutes | 0.56 μm | A |

TABLE 8

| | Emulsion | Heating condition: Heating temperature | Heating condition: Heating time | Evaluation for thickness uniformity | Image evaluation |
|---|---|---|---|---|---|
| Comparative Example 11 | Comparative Example 1 | 130° C. | 60 minutes | 0.77 μm | C |
| Comparative Example 12 | Comparative Example 2 | 130° C. | 60 minutes | 0.72 μm | D |
| Comparative Example 13 | Comparative Example 3 | 130° C. | 60 minutes | 0.76 μm | C |
| Comparative Example 14 | Comparative Example 4 | 130° C. | 60 minutes | 0.78 μm | D |
| Comparative Example 15 | Comparative Example 1 | 150° C. | 60 minutes | 0.74 μm | C |
| Comparative Example 16 | Comparative Example 2 | 110° C. | 40 minutes | 0.73 μm | C |
| Comparative Example 17 | Comparative Example 3 | 180° C. | 60 minutes | 0.71 μm | C |
| Comparative Example 18 | Comparative Example 4 | 180° C. | 40 minutes | 0.72 μm | C |
| Comparative Example 19 | Comparative Example 5 | 130° C. | 60 minutes | 0.88 μm | D |
| Comparative Example 20 | Comparative Example 6 | 180° C. | 40 minutes | 0.77 μm | C |
| Comparative Example 21 | Comparative Example 8 | 130° C. | 60 minutes | 0.74 μm | C |
| Comparative Example 22 | Comparative Example 9 | 130° C. | 60 minutes | 0.75 μm | C |
| Comparative Example 23 | Comparative Example 10 | 130° C. | 60 minutes | 0.72 μm | C |

As can be seen from comparison between the examples, and Comparative Examples 11 to 18 and 21 to 23, as compared with the emulsion of the present invention containing both the first liquid and the second liquid, the emulsion formed only of the first liquid having the construction described in Patent Literature 1 was poor in uniformity of a coat when the coat was formed with the emulsion that had been left to stand still for a long time period. This may be because of the following reason. The agglomeration of oil droplets occurred owing to the coalescence of the oil droplets after the long-term storage of the emulsion to impair the uniformity of an oil droplet in the emulsion, with the result that the uniformity of the surface of the coat after the formation of the coat deteriorated. In addition, increasing the heating temperature for the coat to a temperature higher than the melting point of the charge transporting substance does not lead to the acquisition of sufficient coat uniformity, though the increase shows an improvement in coat uniformity.

In addition, as can be seen from comparison between the examples, and Comparative Examples 19 and 20, the emulsion formed only of the first liquid may be unable to provide sufficient coat uniformity as compared with that of the emulsion of the present invention containing both the first liquid and the second liquid even when the emulsion is not stored for a long time period. This shows that, with the hydrophobic liquid as the first liquid alone, the particle diameter of an emulsified particle is not sufficiently reduced under a certain condition and hence it is difficult to obtain sufficient uniformity of a coat even after the formation of the coat.

In addition, it was confirmed from Examples 157 and 158 that an organic electroluminescence device produced as an organic device with the emulsion of the present invention showed good charge transporting performance.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2011-282083, filed Dec. 22, 2011, and 2012-267389, filed Dec. 6, 2012 which are hereby incorporated by reference herein in their entirety.

The invention claimed is:

1. A method of producing an electrophotographic photosensitive member which comprises a support and a charge transporting layer formed thereon, the method comprising the steps of:

preparing a solution comprising (i) a first liquid whose solubility in water under 25° C. and 1 atmosphere is 1.0 mass % or less, (ii) a second liquid whose solubility in water under 25° C. and 1 atmosphere is 5.0 mass % or more, (iii) a charge transporting substance, and (iv) a binder resin;

preparing an emulsion by dispersing the solution in water;

forming a coat for the charge transporting layer by using the emulsion; and forming the charge transporting layer by heating the coat.

2. The method of producing the electrophotographic photosensitive member according to claim 1, wherein the second liquid comprises at least one selected from the group consisting of tetrahydrofuran, dimethoxymethane, 1,2-dioxane, 1,3-dioxane, 1,4-dioxane, 1,3,5-trioxane, methanol, 2-pentanone, ethanol, tetrahydropyran, diethylene glycol dimethyl ether, ethylene glycol dimethyl ether, propylene glycol n-butyl ether, propylene glycol monopropyl ether, ethylene glycol monomethyl ether, diethylene glycol monoethyl ether, ethylene glycol monoisopropyl ether, ethylene glycol monobutyl ether, ethylene glycol monoisobutyl ether, ethylene glycol monoallyl ether, propylene glycol monomethyl ether, dipropylene glycol monomethyl ether, tripropylene glycol monomethyl ether, propylene glycol monobutyl ether, propylene glycol monomethyl ether acetate, diethylene glycol methyl ethyl ether, diethylene glycol diethyl ether, dipropylene glycol dimethyl ether, propylene glycol diacetate, methyl acetate, ethyl acetate, n-propyl alcohol, 3-methoxybutanol, 3-methoxybutyl acetate, and ethylene glycol monomethyl ether acetate.

3. The method of producing the electrophotographic photosensitive member according to claim 2, wherein the binder resin is soluble in the first liquid.

4. The method of producing the electrophotographic photosensitive member according to claim 3, wherein the second liquid is a liquid whose solubility in water under 25° C. and 1 atmosphere is 20.0 mass % or more.

5. The method of producing the electrophotographic photosensitive member according to claim 3, wherein a ratio (w/(a+b+r+ct)) in the emulsion is 5/5 to 7/3, where "w" represents the mass of the water in the emulsion, "a" represents the mass of the first liquid in the emulsion, "b" represents the mass of the second liquid in the emulsion, "ct" represents the mass of the charge transporting substance in the emulsion, and "r" represents the mass of the binder resin in the emulsion.

6. The method of producing the electrophotographic photosensitive member according to claim 2, wherein the second liquid is a liquid whose solubility in water under 25° C. and 1 atmosphere is 20.0 mass % or more.

7. The method of producing the electrophotographic photosensitive member according to claim 6, wherein a ratio (w/(a+b+r+ct)) in the emulsion is 5/5 to 7/3, where "w" represents the mass of the water in the emulsion, "a" represents the mass of the first liquid in the emulsion, "b" represents the mass of the second liquid in the emulsion, "ct" represents the mass of the charge transporting substance in the emulsion, and "r" represents the mass of the binder resin in the emulsion.

8. The method of producing the electrophotographic photosensitive member according to claim 2, wherein a ratio (w/(a+b+r+ct)) in the emulsion is 5/5 to 7/3, where "w" represents the mass of the water in the emulsion, "a" represents the mass of the first liquid in the emulsion, "b" represents the mass of the second liquid in the emulsion, "ct" represents the mass of the charge transporting substance in the emulsion, and "r" represents the mass of the binder resin in the emulsion.

9. The method of producing the electrophotographic photosensitive member according to claim 1, wherein the binder resin is soluble in the first liquid.

10. The method of producing the electrophotographic photosensitive member according to claim 9, wherein the second liquid is a liquid whose solubility in water under 25° C. and 1 atmosphere is 20.0 mass % or more.

11. The method of producing the electrophotographic photosensitive member according to claim 10, wherein a ratio (w/(a+b+r+ct)) in the emulsion is 5/5 to 7/3, where "w" represents the mass of the water in the emulsion, "a" represents the mass of the first liquid in the emulsion, "b" represents the mass of the second liquid in the emulsion, "ct" represents the mass of the charge transporting substance in the emulsion, and "r" represents the mass of the binder resin in the emulsion.

12. The method of producing the electrophotographic photosensitive member according to claim 9, wherein a ratio (w/(a+b+r+ct)) in the emulsion is 5/5 to 7/3, where "w" represents the mass of the water in the emulsion, "a" represents the mass of the first liquid in the emulsion, "b" represents the mass of the second liquid in the emulsion, "ct" represents the mass of the charge transporting substance in the emulsion, and "r" represents the mass of the binder resin in the emulsion.

13. The method of producing the electrophotographic photosensitive member according to claim 1, wherein the second liquid is a liquid whose solubility in water under 25° C. and 1 atmosphere is 20.0 mass % or more.

14. The method of producing the electrophotographic photosensitive member according to claim 13, wherein a ratio (w/(a+b+r+ct)) in the emulsion is 5/5 to 7/3, where "w" represents the mass of the water in the emulsion, "a" represents the mass of the first liquid in the emulsion, "b" represents the mass of the second liquid in the emulsion, "ct" represents the mass of the charge transporting substance in the emulsion, and "r" represents the mass of the binder resin in the emulsion.

15. The method of producing the electrophotographic photosensitive member according to claim 1, wherein a ratio (w/(a+b+r+ct)) in the emulsion is 5/5 to 7/3, where "w" represents the mass of the water in the emulsion, "a" represents the mass of the first liquid in the emulsion, "b" represents the mass of the second liquid in the emulsion, "ct" represents the mass of the charge transporting substance in the emulsion, and "r" represents the mass of the binder resin in the emulsion.

16. The method of producing the electrophotographic photosensitive member according to claim 1, wherein a ratio (a/b) of the mass of the first liquid (a) to the mass of the second liquid (b) in the emulsion is 1/9 to 9/1.

17. The method of producing the electrophotographic photosensitive member according to claim 1, wherein the first liquid is at least one liquid selected from the group consisting of toluene and xylene.

18. The method of producing the electrophotographic photosensitive member according to claim 1, wherein the second liquid is at least one liquid selected from the group consisting of tetrahydrofuran and dimethoxymethane.

19. A method of producing an organic device comprising a charge transporting layer, the method comprising the steps of:

preparing a solution comprises (i) a first liquid whose solubility in water under 25° C. and 1 atmosphere is 1.0 mass % or less, (ii) a second liquid whose solubility in water under 25° C. and 1 atmosphere is 5.0 mass % or more, (iii) a charge transporting substance, and (iv) a binder resin;

preparing an emulsion by dispersing the solution in water;

forming a coat for the charge transporting layer by using the emulsion; and forming the charge transporting layer by heating the coat.

20. The method of producing the organic device according to claim 19, wherein the second liquid comprises at least one selected from the group consisting of tetrahydrofuran, dimethoxymethane, 1,2-dioxane, 1,3-dioxane, 1,4-dioxane, 1,3,5-trioxane, methanol, 2-pentanone, ethanol, tetrahydropyran, diethylene glycol dimethyl ether, ethylene glycol dimethyl ether, propylene glycol n-butyl ether, propylene glycol monopropyl ether, ethylene glycol monomethyl ether, diethylene glycol monoethyl ether, ethylene glycol monoisopropyl ether, ethylene glycol monobutyl ether, ethylene glycol monoisobutyl ether, ethylene glycol monoallyl ether, propylene glycol monomethyl ether, dipropylene glycol monomethyl ether, tripropylene glycol monomethyl ether, propylene glycol monobutyl ether, propylene glycol monomethyl ether acetate, diethylene glycol methyl ethyl ether, diethylene glycol diethyl ether, dipropylene glycol dimethyl ether, propylene glycol diacetate, methyl acetate, ethyl acetate, n-propyl alcohol, 3-methoxybutanol, 3-methoxybutyl acetate, and ethylene glycol monomethyl ether acetate.

* * * * *